US011388939B2

(12) United States Patent
Bergman

(10) Patent No.: US 11,388,939 B2
(45) **Date of Patent: *Jul. 19, 2022**

(54) EARLESS FILTER MASK

(71) Applicant: Marleen Myers Bergman, Houston, TX (US)

(72) Inventor: Marleen Myers Bergman, Houston, TX (US)

( * ) Notice: Subject to any disclaimer, the term of this patent is extended or adjusted under 35 U.S.C. 154(b) by 835 days.

This patent is subject to a terminal disclaimer.

(21) Appl. No.: 16/268,710

(22) Filed: Feb. 6, 2019

(65) Prior Publication Data

US 2019/0166929 A1 Jun. 6, 2019

Related U.S. Application Data

(63) Continuation-in-part of application No. 15/271,688, filed on Sep. 21, 2016, now Pat. No. 10,449,398.

(51) Int. Cl.

| | |
|---|---|
| ***A62B 23/02*** | (2006.01) |
| ***A41D 13/11*** | (2006.01) |
| ***A62B 18/10*** | (2006.01) |
| ***A62B 18/02*** | (2006.01) |
| *A62B 18/08* | (2006.01) |

(52) U.S. Cl.

CPC ..... *A41D 13/1138* (2013.01); *A41D 13/1161* (2013.01); *A62B 18/025* (2013.01); *A62B 18/10* (2013.01); *A62B 23/025* (2013.01); *A62B 18/084* (2013.01)

(58) Field of Classification Search

CPC . A62B 23/025; A62B 18/084; A41D 13/1164; A41D 13/1107; A41D 13/1138

See application file for complete search history.

(56) References Cited

U.S. PATENT DOCUMENTS 3,154,073 A * 10/1964 Klinger ..... A41D 13/11 24/316
3,521,630 A * 7/1970 Westberg ..... A62B 23/025 55/528

(Continued)

FOREIGN PATENT DOCUMENTS

| | | | |
|---|---|---|---|
| JP | 2015042231 | A | 3/2015 |
| WO | 2018003831 | A1 | 1/2018 |
| WO | 2018057491 | A1 | 3/2018 |

OTHER PUBLICATIONS

International Search Report of the International Searching Authority (USPTO) for international application PCT/US2017/52187 dated Nov. 24, 2017.

(Continued)

*Primary Examiner* — Bradley H Philips

(74) *Attorney, Agent, or Firm* — Basil M. Angelo; Angelo IP

(57) ABSTRACT

An earless filter mask includes an inner fabric layer, a first filter layer, a second filter layer, an outer fabric layer, an elastic material, and an exhalation valve. The inner fabric layer, the first filter layer, the second filter layer, and the outer fabric layer are stacked and aligned, the elastic material is folded over an edge of the layers, and sewn together along the edge. The elastic material conforms the mask to a shape of a wearer's face and a first tapered end of the mask is removably connected to a second tapered end of the mask by a closure device that sits at the nape of the wearer's neck.

18 Claims, 23 Drawing Sheets

(56) References Cited

U.S. PATENT DOCUMENTS

| | | | | |
|---|---|---|---|---|
| 6,338,340 | B1 | 1/2002 | Finch et al. | |
| D820,434 | S | 6/2018 | Bergman | |
| 10,449,398 | B2 | 10/2019 | Bergman | |
| D877,885 | S | 3/2020 | Bergman | |
| 2005/0051172 | A1 | 3/2005 | Lee | |
| 2005/0172968 | A1 | 8/2005 | Hishida | |
| 2007/0023047 | A1* | 2/2007 | Zalsman | A41D 13/11 128/206.19 |
| 2009/0211581 | A1* | 8/2009 | Bansal | B32B 5/026 128/205.29 |
| 2010/0031962 | A1* | 2/2010 | Chiu | A41D 13/1161 128/206.19 |
| 2010/0101584 | A1* | 4/2010 | Bledstein | A62B 18/10 128/863 |
| 2010/0154805 | A1* | 6/2010 | Duffy | A62B 23/025 128/863 |
| 2011/0180078 | A1* | 7/2011 | McKinley | A62B 23/025 128/863 |
| 2015/0101617 | A1* | 4/2015 | Duffy | A62B 18/084 29/419.1 |
| 2015/0314148 | A1* | 11/2015 | Waterford | A62B 18/082 128/863 |
| 2018/0078797 | A1 | 3/2018 | Bergman | |
| 2019/0217032 | A1* | 7/2019 | Shariff | A41D 13/11 |

OTHER PUBLICATIONS

Video entitled "3M™ Half Facepiece Respirator 7500 Series Training Video—Full" obtained from https://youtu.be/mIWyMPFwEI8.

Video entitled "Respro Techno Anti-Pollution Mask Review" obtained from https://youtu.be/SO7TKi7MVz8.

Written Opinion of the International Searching Authority (USPTO) for international application PCT/US2017/52187 dated Nov. 24, 2017.

USPTO Notice of Allowance issued in Design U.S. Appl. No. 29/679,435, filed Feb. 6, 2019, and dated Jan. 29, 2020.

USPTO Notice of Allowance issued in Design U.S. Appl. No. 29/578,394, dated May 16, 2018.

USPTO Notice of Allowance issued in U.S. Appl. No. 15/271,688, dated Sep. 5, 2019.

PCT International Search Report of the International Search Authority for PCT/US2020/014252, filed Jan. 20, 2020, dated Apr. 21, 2020.

PCT Written Opinion of the International Search Authority for PCT/US2020/014252, filed Jan. 20, 2020, dated Apr. 21, 2020.

* cited by examiner

EARLESS FILTER MASK

CROSS-REFERENCE TO RELATED APPLICATIONS

This application is a continuation-in-part of U.S. patent application Ser. No. 15/271,688, filed on Sep. 21, 2016, which is hereby incorporated by reference in its entirety.

BACKGROUND OF THE INVENTION

Air pollution occurs when undesirable gases or particles are introduced into the air that humans breathe. Common pollutants include, for example, carbon monoxide, sulfur dioxide, nitrogen oxides, ground-level ozone, lead, sand, dust particles, and other particulate matter. In large cities around the world, man-made air pollution and pollution related ailments tend to increase with population density. Common pollution related ailments include respiratory diseases, cardiovascular diseases, cancers, adverse pregnancy outcomes, and even death. Conventional pollution masks seek to protect the wearer from inhaling certain gases or particles in polluted areas.

BRIEF SUMMARY OF THE INVENTION

According to one aspect of one or more embodiments of the present invention, an earless filter mask includes an inner fabric layer, a first filter layer, a second filter layer, an outer fabric layer, an elastic material, and an exhalation valve. The inner fabric layer, the first filter layer, the second filter layer, and the outer fabric layer are stacked together and aligned, the elastic material is folded over an edge of the layers, and sewn together along the edge. The elastic material conforms the mask to a shape of a wearer's face and a first tapered end of the mask is removably connected to a second tapered end of the mask by a closure device that sits at the nape of the wearer's neck.

Other aspects of the present invention will be apparent from the following description and claims.

DETAILED DESCRIPTION OF THE INVENTION

Figure 1:
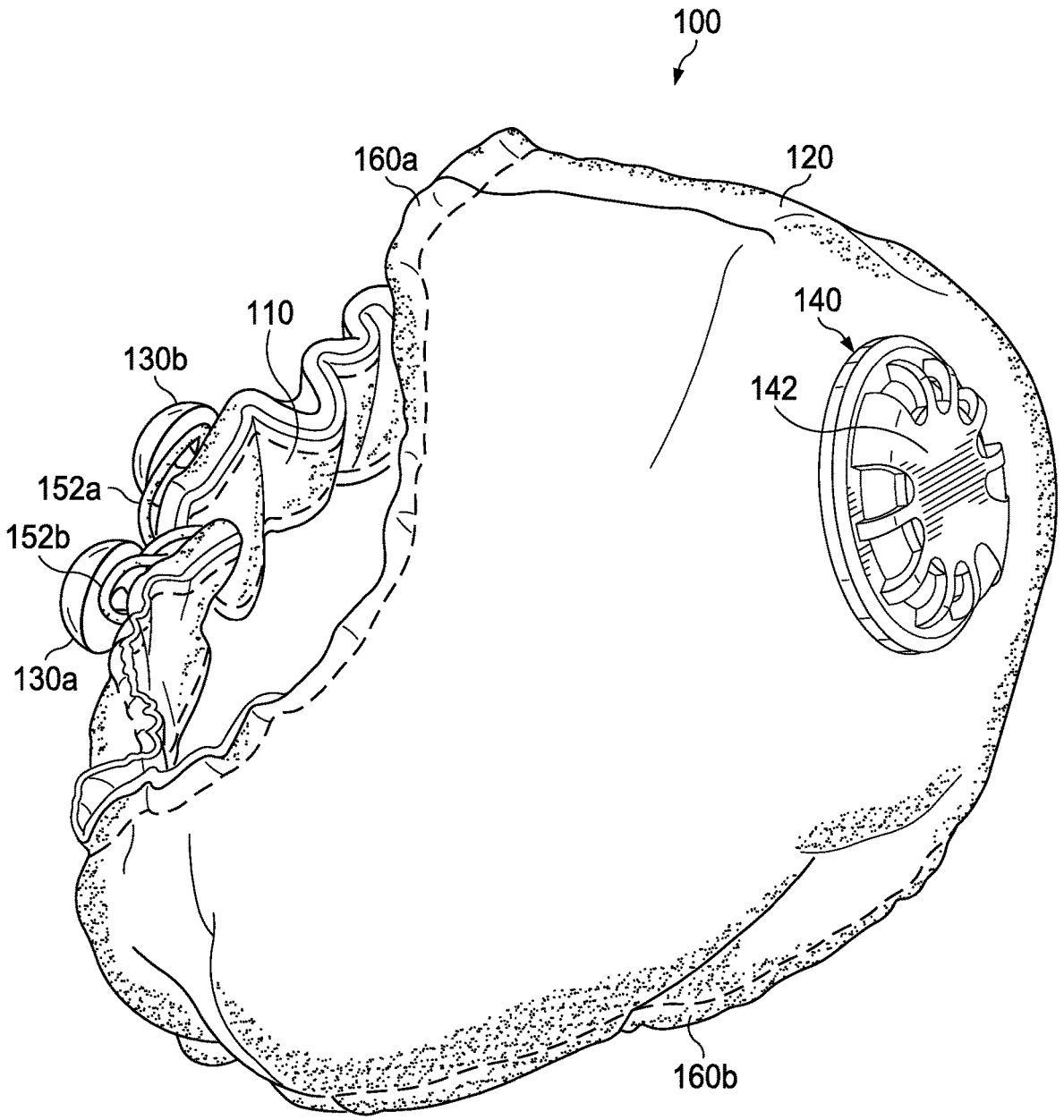
FIG. 1 shows a perspective view of an earless filter mask in accordance with one or more embodiments of the present invention.

One or more embodiments of the present invention are described in detail with reference to the accompanying figures. For consistency, like elements in the various figures are denoted by like reference numerals. In the following detailed description of the present invention, specific details are set forth in order to provide a detailed understanding of the present invention. In other instances, well-known features to one of ordinary skill in the art are not described to avoid obscuring the description of the present invention.

Conventional pollution masks suffer from a number of functional, ergonomic, and aesthetic issues that prevent their widespread adoption and use. These pollution masks are typically made of a bulky and non-breathable material that is poorly fitted to a wearer's face by pulling elastic loops around the wearer's ears. In addition to being uncomfortable to wear, these pollution masks fail to conform completely to the contours of the wearer's face, thereby allowing for the unintended inhalation of polluted air. Some commercially available masks include a metal bracket that the wearer may pinch over the bridge of the nose to help hold the mask in place. However, even with these brackets, these masks do not conform completely and pollution may still enter the interior breathing area of the mask.

Conventional pollution masks are typically made of a non-breathable material that poses a number of issues including the build-up of moisture on the interior facing portion of the mask and a warm sensation for the wearer that makes long term wear unpleasant. While non-breathable, fine particulate matter may still traverse the barrier of the non-breathable material and enter the interior breathing area of the mask. For these and other reasons, tolerance of conventional pollution masks is very low and most wearers prefer not to wear them for extended periods of time. Moreover, conventional pollution masks lack aesthetic appeal and are not appealing to women. For example conventional pollution masks typically have a masculine appearance, interfere with the wearing of earrings, and do not match well with a female ensemble.

Accordingly, in one or more embodiments of the present invention, an earless filter mask provides a small profile mask made of a soft breathable material that conforms to the shape of a wearer's face, is comfortable to wear for extended periods of time, prevents the unintentional inhalation of polluted air, and is aesthetically pleasing. In one or more embodiments of the present invention, an earless filter mask may include a multi-layer construction that, at least partially, wraps around and conforms to the shape of the wearer's face and tapers down in size to fasten at the nape of the wearer's neck below the ears, without loops that are secured to the ears. One or more filter layers may prevent the inhalation of polluted air through the fabric layers of the mask, while remaining constructed of breathable material, and a single exhalation valve may allow a wearer to breathe out while wearing the mask without the buildup of gases within the interior breathing area of the mask or a warm sensation for the wearer.

FIG. 1 shows a perspective view of an earless filter mask 100 in accordance with one or more embodiments of the present invention. Earless filter mask 100 may include an inner fabric layer 110, one or more filter layers (not shown), an outer fabric layer 120, a plurality of buttons 130*a* and 130*b*, and an exhalation valve 140 (outer portion 142 shown). A conforming band (not independently illustrated) may be sewn into an upper and a lower edge of mask 100 through in-seam sleeves 160*a* and 160*b* with a first exposed portion 152*a* extending beyond a first tapered end of mask 100 and a second exposed portion 152*b* extending beyond a second tapered end of mask 100. The conforming band (not independently illustrated) may conform mask 100 to a shape of the wearer's face (not shown) and a first tapered end of mask 100 may be removably connected to a second tapered end of mask 100 at the nape of the wearer's neck (not shown) below the wearer's ears (not shown). For example, first exposed portion 152*a* of the conforming band that extends beyond the first tapered end of mask 100 may be pulled around button 130*b* disposed on the opposing tapered end of mask 100. Similarly, second exposed portion 152*b* of the conforming band that extends beyond the second tapered end of mask 100 may be pulled around button 130*a* disposed on the opposing tapered end of mask 100, thereby securing mask 100 around the nape of the wearer's neck (not shown).

In certain embodiments, mask 100 may include a decorative layer (not shown), such as, for example, lace accoutrements, disposed on the outer facing surface of outer fabric layer 120, that may be aesthetically pleasing and coordinated with the wearer's ensemble. In certain embodiments, secondary pieces of fabric such as, for example, a coordinating scarf (not shown) with buttonholes may be attached to mask 100 by buttoning over buttons 130*a* and 130*b*. For example, a secondary piece of fabric (not shown) may be attached to buttons 130*a* and 130*b* at the tapered ends of mask 100, and then crossed at the back to then wrap from the back of neck to the front of the neck to tie at the front of the neck, thereby covering the neck. Alternatively, a secondary piece of fabric (not shown) may be crossed at the back of the neck and brought up the sides of the face, over or behind the ears, to tie on the top of the head or on one side of the head as a decorative feature. Larger pieces of secondary fabric may also be attached to mask 100, crossed and wrapped to cover the hair and chest area entirely, providing a modesty cover for religious or other purposes.

Figure 2:
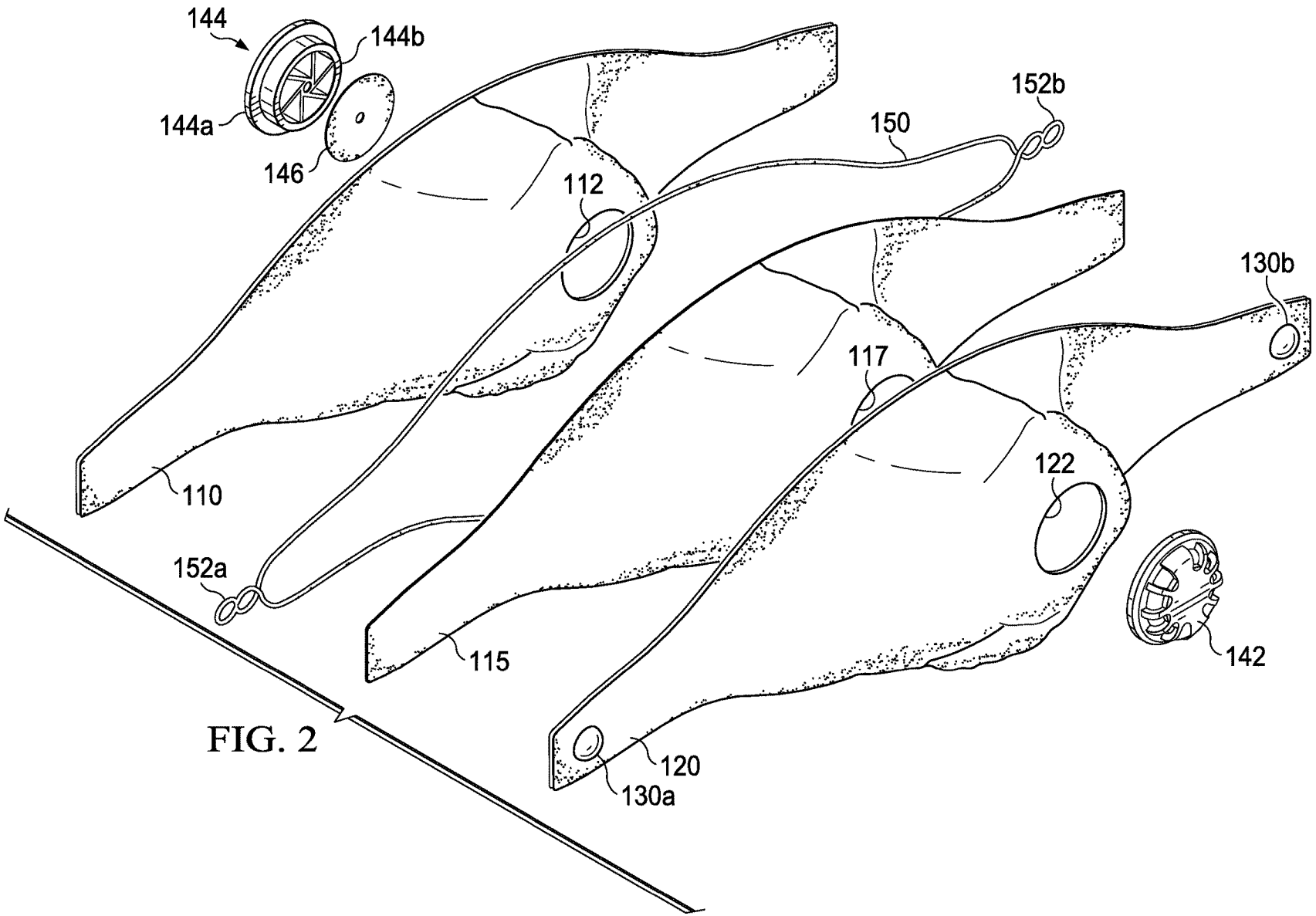
FIG. 2 shows an exploded perspective view of an earless filter mask in accordance with one or more embodiments of the present invention.

FIG. 2 shows an exploded perspective view of an earless filter mask 100 in accordance with one or more embodiments of the present invention. Earless filter mask 100 may include an inner fabric layer 110 having a first tapered end (left side), a protruding portion (center), and a second tapered end (right side). An interior facing portion (not shown) of inner fabric layer 110 may be in contact with a wearer's face (not shown) when mask 100 is worn. In certain embodiments, inner fabric layer 110 may be composed of soft and breathable cotton or cotton blended fabric material. In other embodiments, inner fabric layer 110 may be composed of non-woven fabric material. In still other embodiments, inner fabric layer 110 may be composed of synthetic or synthetic blended fabric material. In still other embodiments, inner fabric layer 110 may be composed of cotton and synthetic blended fabric material. One of ordinary skill in the art will recognize that other soft and breathable materials may be used in accordance with one or more embodiments of the present invention.

Earless filter mask 100 may also include an outer fabric layer 120. Outer fabric layer 120 may be the exterior facing portion of mask 100 having a first tapered end (left side), a protruding portion (center), and a second tapered end (right side) substantially similar in size and shape to inner fabric layer 110. In certain embodiments, outer fabric layer 120 may be composed of soft and breathable cotton or cotton blended fabric material. In other embodiments, outer fabric layer 120 may be composed of non-woven fabric material. In still other embodiments, outer fabric layer 120 may be composed of synthetic or synthetic blended fabric material. In still other embodiments, outer fabric layer 120 may be composed of cotton and synthetic blended fabric material. One of ordinary skill in the art will recognize that other soft and breathable materials may be used in accordance with one or more embodiments of the present invention. A plurality of buttons 130*a*, 130*b* may be disposed on an outer facing surface of outer fabric layer 120. In certain embodiments, a first button 130*a* may be disposed on an outer facing portion of a first tapered end of outer fabric layer 120 and a second button 130*b* may be disposed on an outer facing surface of a second tapered end of outer fabric layer 120. The plurality of buttons may be used to secure first 152*a* and second exposed 152*b* portions of a conforming band 150 when mask 100 is worn.

Earless filter mask 100 may also include one or more filter layers 115. Filter layer 115 may be an interior layer disposed between inner fabric layer 110 and outer fabric layer 120. Filter layer 115 may have a first tapered end (left side), a protruding portion (center), and a second tapered end (right side) that is substantially similar in size and shape to inner fabric layer 110 and outer fabric layer 120. Filter layer 115 may be composed of a material configured to substantially filter out one or more pollutants, while allowing inner fabric layer 110 and outer fabric layer 120 to remain breathable. In certain embodiments, filter layer 115 may be composed of a carbon filter material. In other embodiments, filter layer 115 may be composed of a micro-particle filter material. In still other embodiments, filter layer 115 may be composed of non-woven fabric. In still other embodiments, filter layer 115 may be composed of synthetic fabric material. In still other embodiments, filter layer 115 may be composed of blended fabric material. One of ordinary skill in the art will recognize that the type or kind of filter layer may vary based on an application or design in accordance with one or more embodiments of the present invention.

Inner fabric layer 110, filter layer 115, and outer fabric layer 120 may be stacked together and aligned and sewn together along an upper and a lower edge (not independently illustrated) of mask 100. An upper in-seam sleeve 160*a* may be formed along the upper edge of mask 100 and a lower in-seam sleeve 160*b* may be formed along the lower edge of mask 100, where sleeves 160*a* and 160*b* are configured to receive a conforming band 150. In FIG. 2, conforming band 150 is shown as it may appear once installed in mask 100. In practice, a first end (not independently illustrated) of conforming band 150 may be threaded through one or more of upper and lower in-seam sleeves 160*a* and 160*b* and then connected to a second end (not independently illustrated) such that a first exposed portion 152*a* may be exposed beyond a first tapered end of mask 100 and a second exposed portion 152*b* may be exposed beyond a second tapered end of mask 100. First exposed portion 152*a* may include one or more loops, formed by twisting band 150, that may be used to connect to button 130*b* and second exposed portion 152*b* may include one or more loops, formed by twisting band 150, that may be used to connect to button 130*a*. One of ordinary skill in the art will recognize that the number of loops may vary to accommodate fit and size in accordance with one or more embodiments of the present invention. Conforming band 150 may be composed of a flexible, semi-rigid, and bendable material that provides a limited amount of stretching ability. In certain embodiments, conforming band 150 may be composed of an elastic material. In other embodiments, conforming band 150 may be composed of a non-woven fabric material. In still other embodiments, conforming band 150 may be composed of synthetic fabric material. In still other embodiments, conforming band 150 may be composed of blended fabric material. One of ordinary skill in the art will recognize that other flexible, semi-rigid, and bendable materials may be used in accordance with one or more embodiments of the present invention.

Inner fabric layer 110, filter layer 115, and outer fabric layer 120 may include cutouts 112, 117, and 122 at a location corresponding to the approximate location of the nose and mouth of the wearer (not shown) that are configured to receive an exhalation valve 140 (142, 144, and 146 collectively referred to as 140). Exhalation valve 140 may allow the wearer (not shown) to breathe out while wearing mask 100 without the buildup of gases within the interior breathing area of mask 100. In addition, exhalation valve 140 may minimize moisture buildup inside mask 100 and the associated fogging of eyewear (not shown) while wearing mask 100. Exhalation valve 140 may include an outer facing portion 142 disposed on, or otherwise secured to, an outer facing portion of outer fabric layer 120, around cutout 122 of outer fabric layer 120. Exhalation valve 140 may also include an inner facing portion 144 having a first distal end 144*a* exposed on an interior facing portion of inner fabric layer 110 and a second distal end 144*b* that extends through cutouts 112, 117, and 122 in inner fabric layer 110, filter layer 115, and outer fabric layer 120. Inner facing portion 144 may be removably attached to outer facing portion 142 of exhalation valve 140 with a removable valve flap 146 disposed between inner facing portion 144 and outer facing portion 142. In certain embodiments, valve flap 146 may be composed of a rubber material. In other embodiments, valve flap 146 may be composed of non-woven or other fabric material. In still other embodiments, valve flap 146 may be composed of synthetic fabric or blended fabric material. One of ordinary skill in the art will recognize that other filter materials may be used in accordance with one or more embodiments of the present invention.

Figure 3:
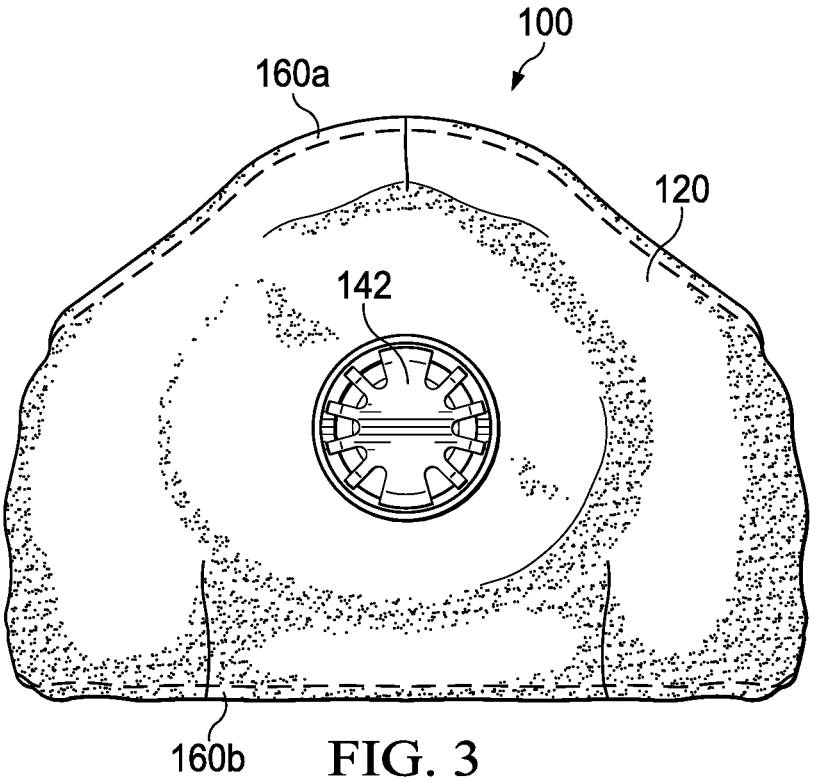
FIG. 3 shows a front elevation view of an earless filter mask in accordance with one or more embodiments of the present invention.

FIG. 3 shows a front elevation view of an earless filter mask 100 in accordance with one or more embodiments of the present invention. From the front elevation view, the protruding portion (center) of mask 100 that covers the wearer's nose and mouth (not shown) is shown. A conforming band (150 of FIG. 2) may be disposed within the upper 160*a* and lower 160*b* in-seam sleeves. The conforming band (150 of FIG. 2) allows mask 100 to conform to the shape of the wearer's face (not shown). The portion of the conforming band (150 of FIG. 2) disposed within upper in-seam sleeve 160*a* allows mask 100 to conform, for example, to the shape of the wearer's face from the bridge of the nose to the cheeks (not shown) and the portion of the conforming band (150 of FIG. 2) disposed within lower in-seam sleeve 160*b* allows mask 100 to conform, for example, to the shape of the wearer's face from the jaw to where the neck meets the jaw (not shown).

Figure 4:
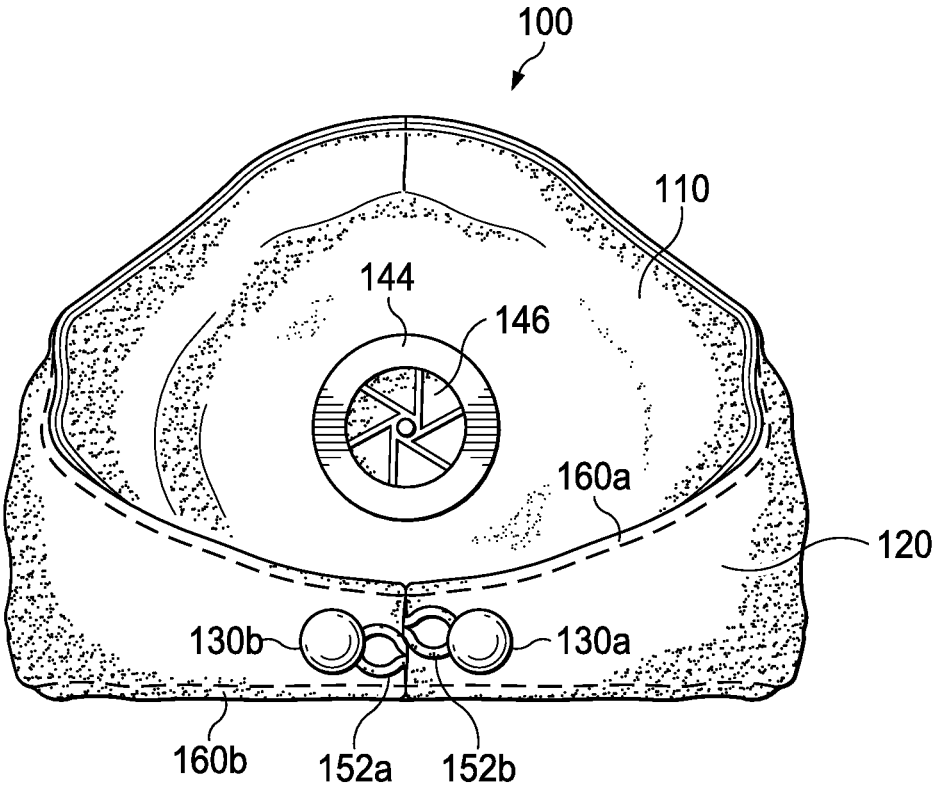
FIG. 4 shows a rear elevation view of an earless filter mask in accordance with one or more embodiments of the present invention.

FIG. 4 shows a rear elevation view of an earless filter mask 100 in accordance with one or more embodiments of the present invention. From the rear elevation view, an interior breathing area of mask 100 is shown. An inner facing portion 144 of exhalation valve 140 and a portion of valve flap 146 are shown. A first tapered end (right tapered side in view) of mask 100 may be connected to a second tapered end (left tapered side in view) of mask 100. For example, a first exposed portion 152*a* of the conforming band (150 of FIG. 2) that extends beyond the first tapered end of mask 100 from in-seam sleeves 160*a* and 160*b* may be secured around button 130*b* disposed on the opposing tapered end of mask 100. Similarly, a second exposed portion 152*b* of the conforming band (150 of FIG. 2) that extends beyond the second tapered end of mask 100 from in-seam sleeves 160*a* and 160*b* may be secured around button 130*a* disposed on the opposing tapered end of mask 100. As discussed above, the conforming band (150 of FIG. 2) allows mask 100 to conform to the shape of the wearer's face (not shown) including around the jaw and neck to the point where the first and second tapered ends of mask 100 are secured to one another at the nape of the wearer's neck (not shown).

Figure 5:
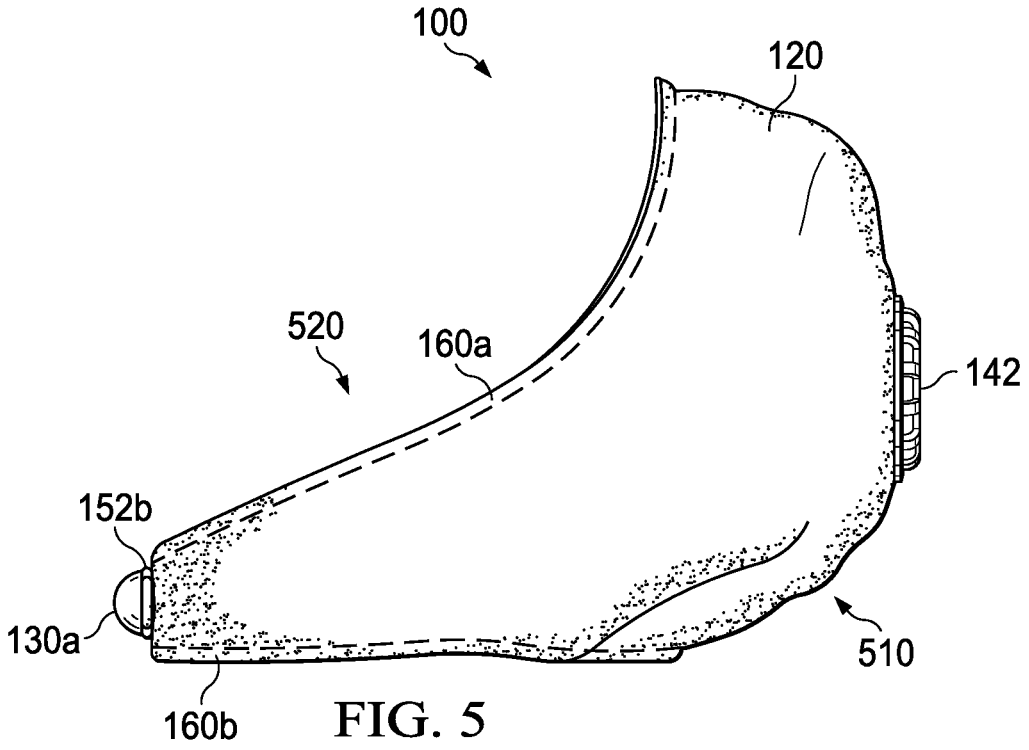
FIG. 5 shows a left side elevation view of an earless filter mask in accordance with one or more embodiments of the present invention.

FIG. 5 shows a left side elevation view of an earless filter mask 100 in accordance with one or more embodiments of the present invention. From the left side elevation view, protruding portion 510 of mask 100 that may be configured to cover the wearer's nose and mouth (not shown) and first tapered end 520 of mask 100 are shown. The tapering down from protruding portion 510 to first tapered end 520 allows first tapered end 520 to be secured to the second tapered end (not shown) at the nape of the wearer's neck (not shown) below the wearer's ears (not shown) while still providing full coverage of the wearer's nose and mouth (not shown). The conforming band (150 of FIG. 2) disposed in upper in-seam sleeve 160*a* and lower in-seam sleeve 160*b* allows mask 100 to conform to the wearer's face (not shown).

Figure 6:
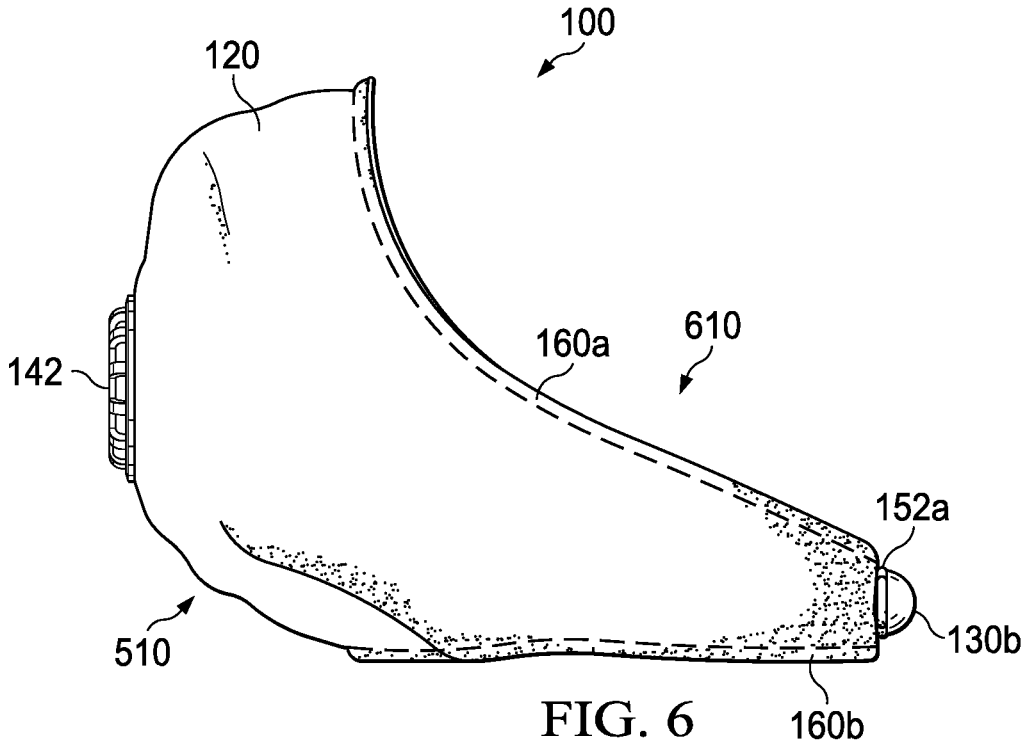
FIG. 6 shows a right side elevation view of an earless filter mask in accordance with one or more embodiments of the present invention.

FIG. 6 shows a right side elevation view of an earless filter mask 100 in accordance with one or more embodiments of the present invention. From the right side elevation view, protruding portion 510 of mask 100 and second tapered end 610 of mask 100 are shown. The tapering down from protruding portion 510 to second tapered end 610 allows the first tapered end (520 of FIG. 5) to be secured to second tapered end 610 at the nape of the wearer's neck (not shown) below the wearer's ears (not shown) while still providing full coverage of the wearer's nose and mouth (not shown). The conforming band (150 of FIG. 2) disposed in upper in-seam sleeve 160*a* and lower in-seam sleeve 160*b* allows mask 100 to conform to the wearer's face (not shown).

Figure 7:
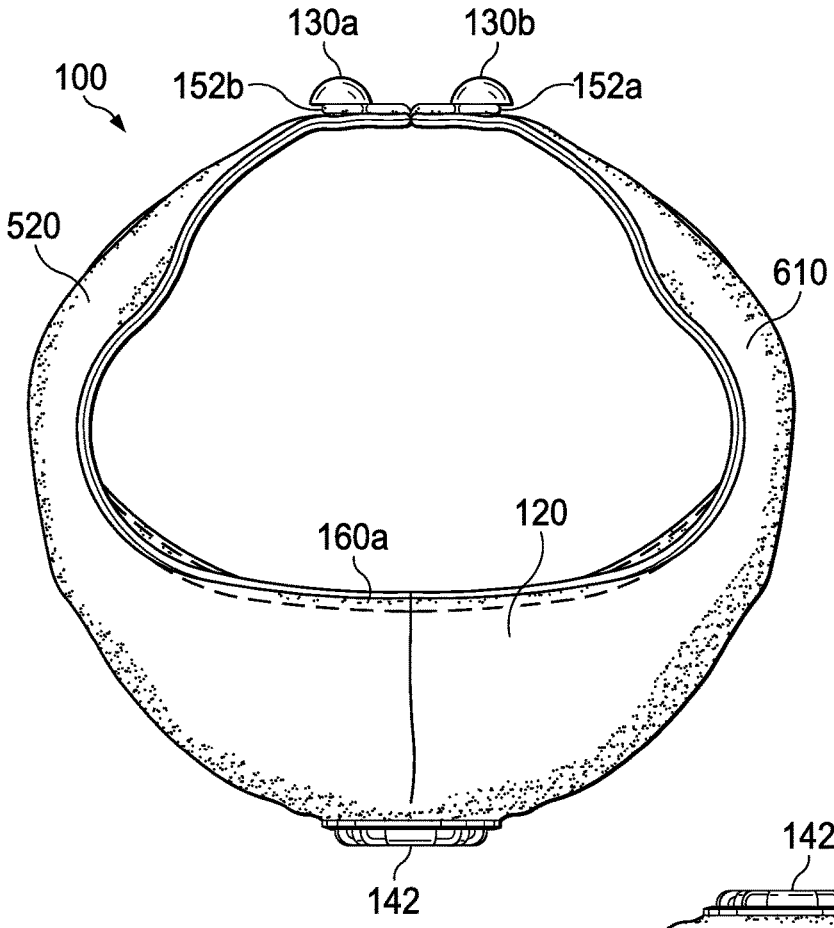
FIG. 7 shows a top plan view of an earless filter mask in accordance with one or more embodiments of the present invention.

FIG. 7 shows a top plan view of an earless filter mask 100 in accordance with one or more embodiments of the present invention. From the top plan view, first tapered end 520 is shown secured to second tapered end 610 as if a wearer (not shown) is wearing mask 100.

Figure 8:
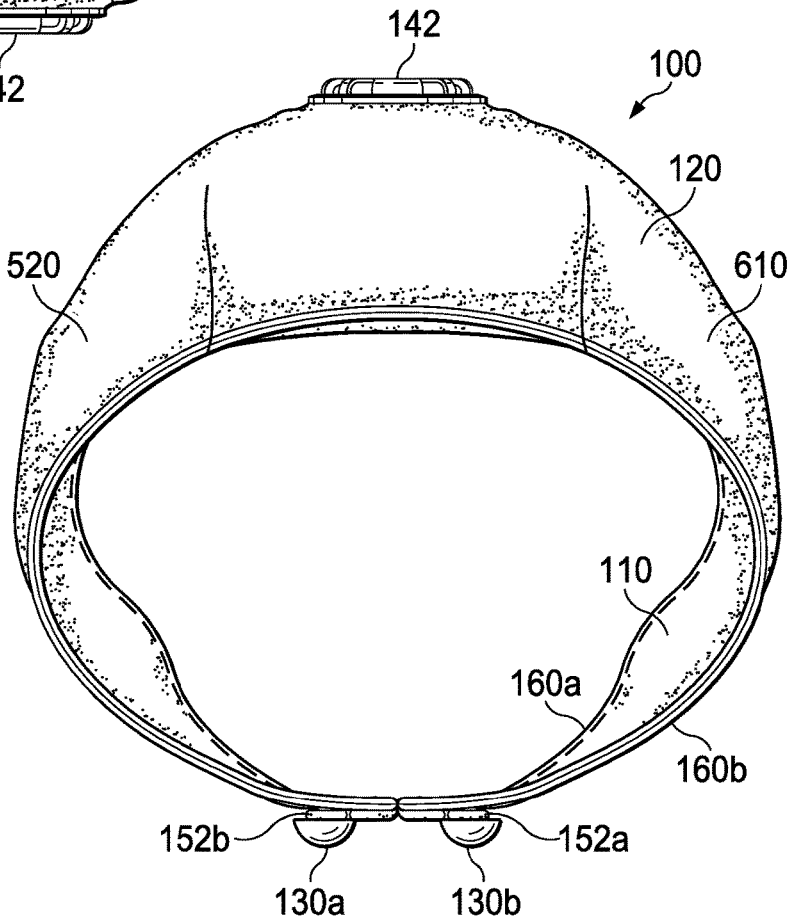
FIG. 8 shows a bottom plan view of an earless filter mask in accordance with one or more embodiments of the present invention.

FIG. 8 shows a bottom plan view of an earless filter mask 100 in accordance with one or more embodiments of the present invention. From the bottom plan view, first tapered end 520 is shown secured to second tapered end 610 as if a wearer (not shown) is wearing mask 100.

Figure 9:
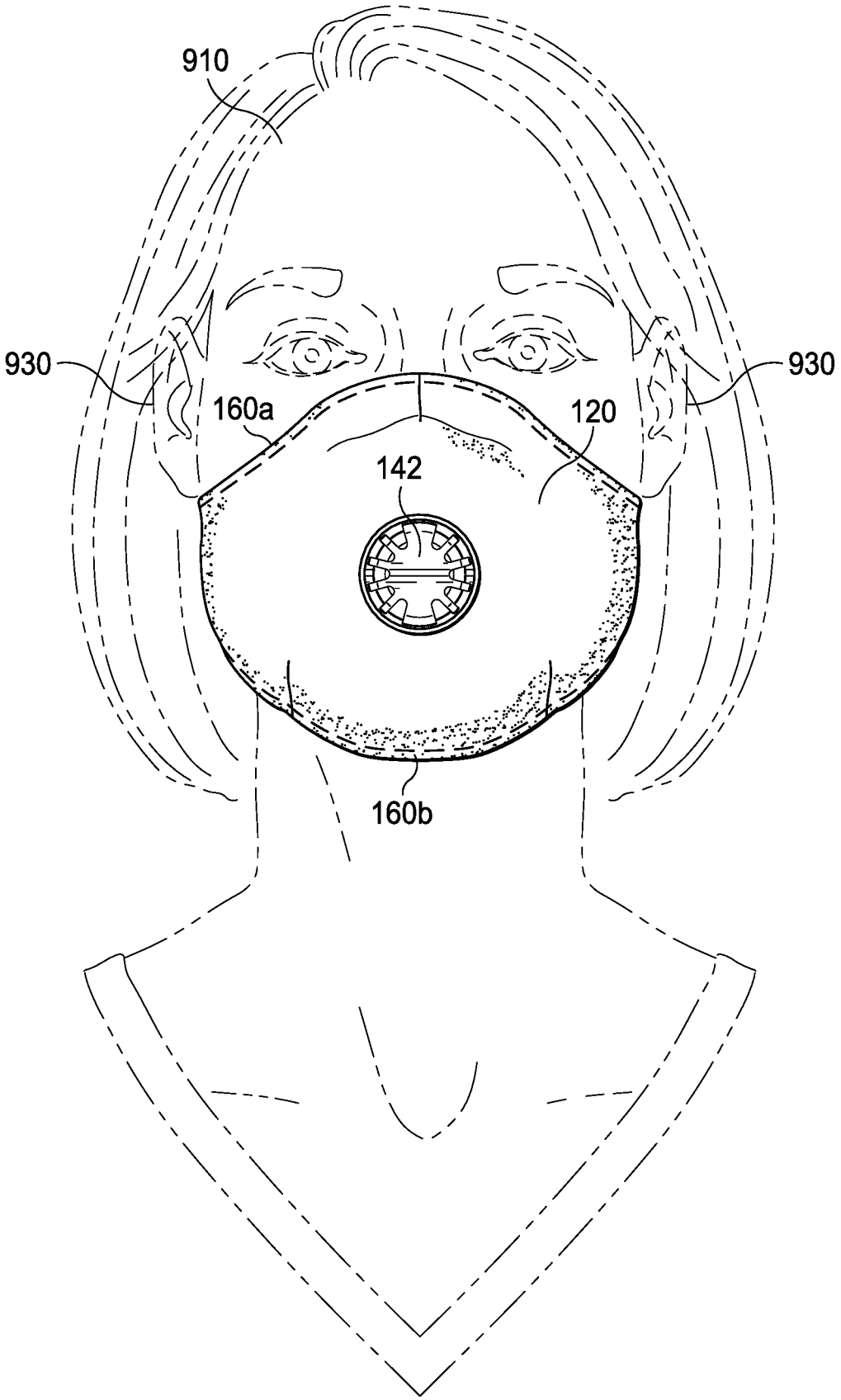
FIG. 9 shows a front elevation environmental view of an earless filter mask in accordance with one or more embodiments of the present invention.

FIG. 9 shows a front elevation environmental view of an earless filter mask 100 in accordance with one or more embodiments of the present invention. A method of filtering air with mask 100 may include placing earless filter mask 100 over a wearer's 910 nose and mouth (not independently illustrated). The method may also include conforming earless filter mask 100 to a shape of the wearer's 910 face. The wearer 910 may run a finger (not shown) along the conforming band (150 of FIG. 2) disposed in upper in-seam sleeve 160*a* and lower in-seam sleeve 160*b* of mask 100 to conform mask 100 to the shape of the wearer's 910 face. Because the conforming band (150 of FIG. 2) is disposed along the upper and the lower edges of mask 100, mask 100 forms a tight seal with the wearer's 910 face including the area from the bridge of the nose to the cheeks and the area along the bottom jawline of the wearer 910. As such, air may enter the mask through the outer fabric layer (120 of FIG. 2), is then filtered by the filter layer (115 of FIG. 2), and then traverses the inner fabric layer (110 of FIG. 2) such that the wearer may breathe the filtered air disposed within the interior breathing area of mask 100.

Figure 10:
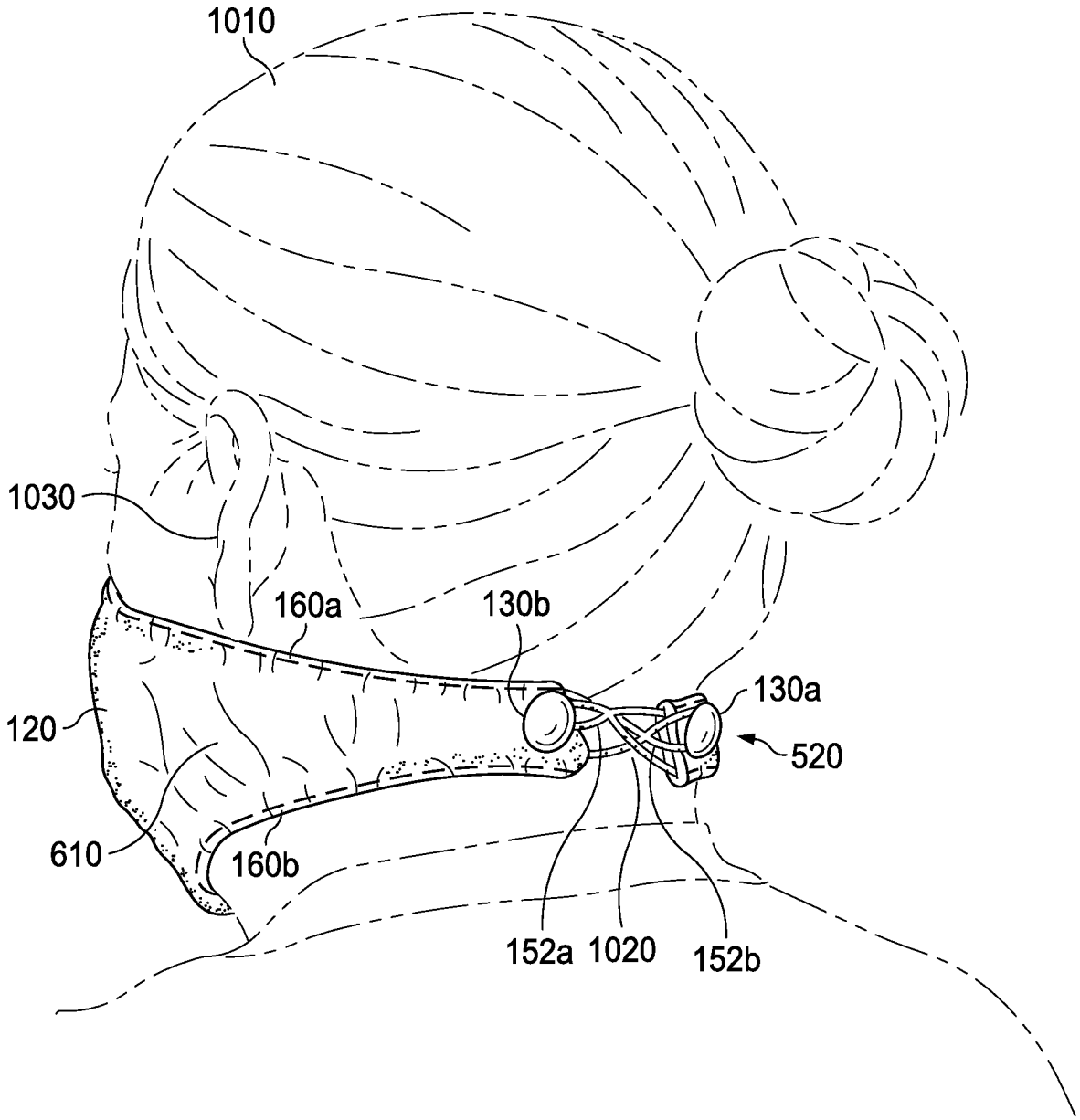
FIG. 10 shows a rear perspective environmental view of an earless filter mask in accordance with one or more embodiments of the present invention.

Continuing, FIG. 10 shows a rear perspective environmental view of an earless filter mask 100 in accordance with one or more embodiments of the present invention. The method may also include connecting a first tapered end 520 of mask 100 to a second tapered end 610 of mask 100 at the nape 1020 below the wearer's 1010 ears 1030. For example, wearer 1010 may pull a first loop (not independently illustrated) of first exposed portion 152*a* of the conforming band (150 of FIG. 2) that extends beyond the first tapered end 520 of mask 100 around button 130*b* disposed on the opposing tapered end 610 of mask 100. Similarly, wearer 1010 may pull a second loop (not independently illustrated) of second exposed portion 152*b* of the conforming band (150 of FIG. 2) that extends beyond the second tapered end 610 of mask 100 around button 130*a* disposed on the opposing tapered end 520 of mask 100, thereby securing mask 100 around the nape 1020 of the wearer's 1010 neck. First exposed portion 152*a* may include one or more loops, formed by twisting band 150, that may be used to connect to button 130*b* and second exposed portion 152*b* may include one or more loops, formed by twisting band 150, that may be used to connect to button 130*a*. One of ordinary skill in the art will recognize that the number of loops may vary to accommodate fit and size in accordance with one or more embodiments of the present invention.

Figure 11:
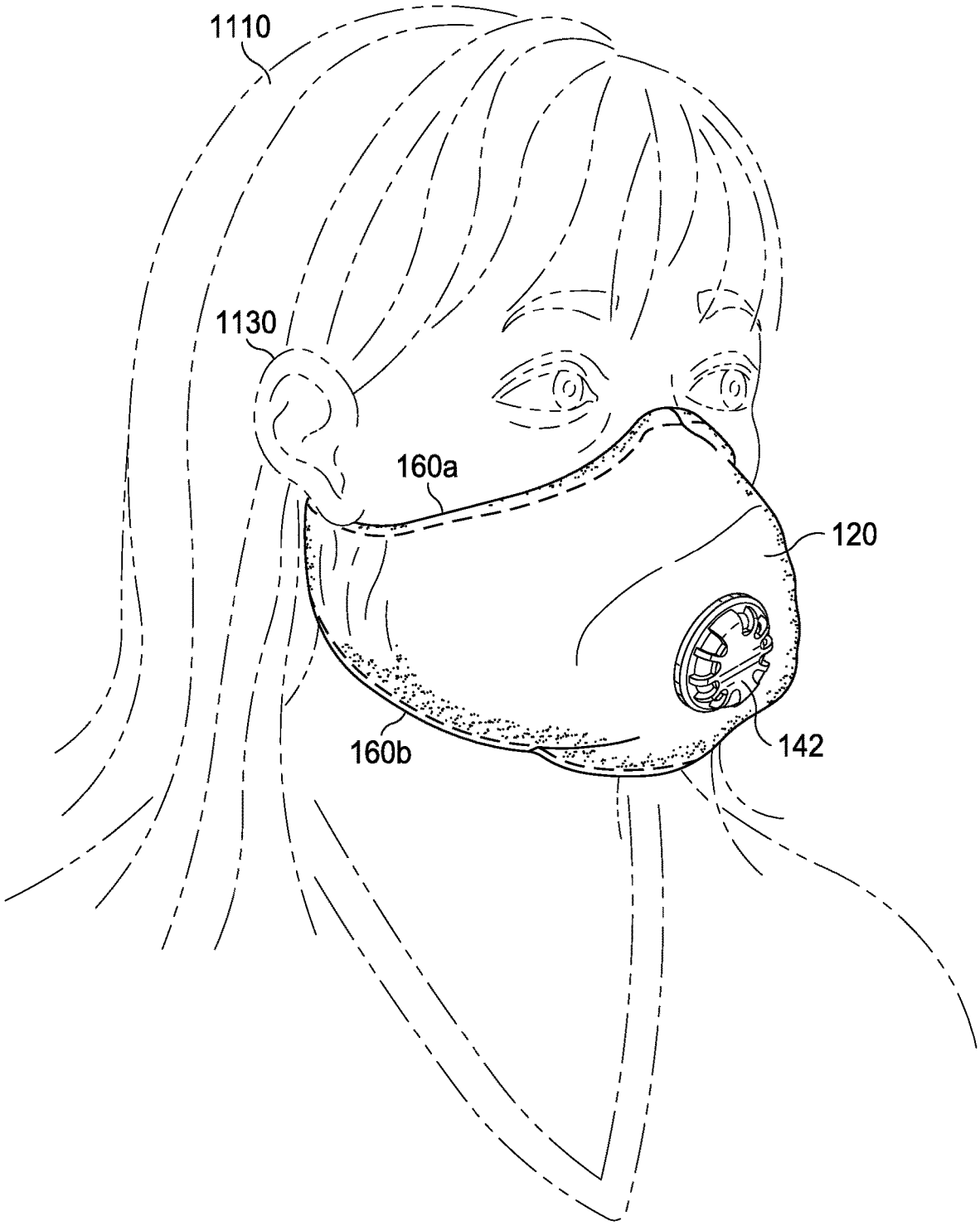
FIG. 11 shows a front perspective environmental view of an earless filter mask in accordance with one or more embodiments of the present invention.

FIG. 11 shows a front perspective environmental view of an earless filter mask 100 in accordance with one or more embodiments of the present invention. From the front perspective environmental view, wearer 1110 is shown wearing mask 100. Mask 100 in situ provides a small profile and is made of a soft breathable material that conforms to the shape of the wearer's 1110 face. Mask 100 may be comfortable to wear for extended periods of time, prevents the unintentional inhalation of polluted air, and is aesthetically pleasing. The filter layer (115 of FIG. 2) may prevent the inhalation of polluted air through the fabric layers of the mask, while remaining constructed of breathable material, and a single exhalation valve (portion 142 shown) may allow a wearer to breathe out while wearing the mask without the buildup of gases within the interior breathing area of the mask 100 or a warm sensation for the wearer 1110.

In one or more embodiments of the present invention, an improved earless filter mask 200 provides improved fit, comfort, and filtering performance. In contrast to earless filter mask 100, earless filter mask 200 uses an elastic material (e.g., 1210) rather than a conforming band (e.g., 160) that improves fit and comfort. In addition, the tapered ends of earless filter mask 200 do not extend to the nape of the wearer's neck. Instead, the first tapered end of mask 200 may be connected to the second tapered end by a closure device (e.g., 1230, 1240) that sits at the nape of the wearer's neck and improves fit and comfort. In addition, earless filter mask 200 may include a plurality of filter layers, in any desired arrangement, that improves the filtering performance. For example, in certain embodiments, a stack of a micro-particle filtering layer and a carbon filtering layer may provide improved filtering performance from micro particulate matter, viruses, bacteria, fumes, pollen, odors, and particles. In other embodiments, a redundant stack of either micro-particle filtering layers or carbon filtering layers may be used.

Figure 12A:
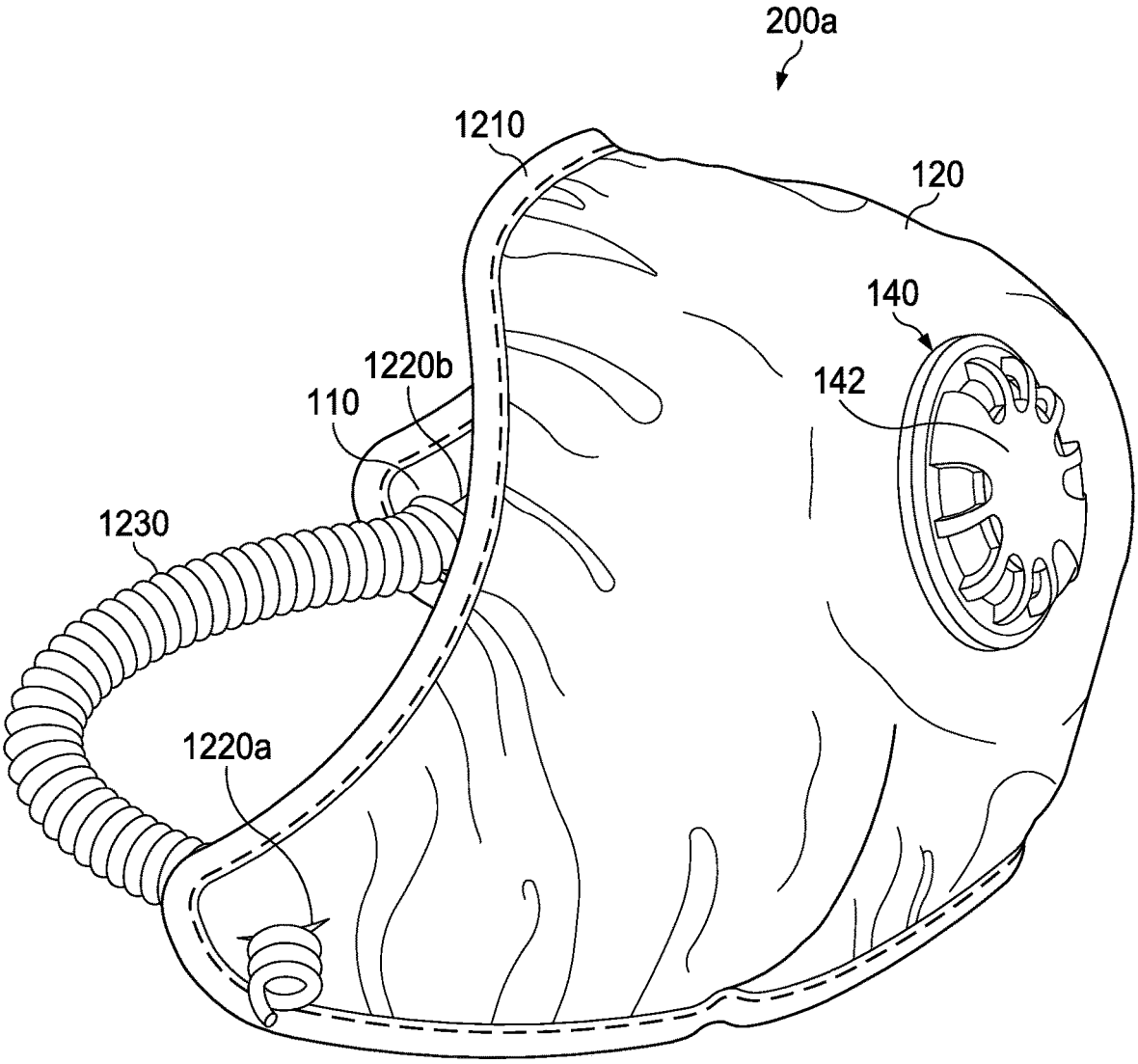
FIGS. 12A and 12B show a perspective view of an earless filter mask in accordance with one or more embodiments of the present invention.

FIG. 12A shows a perspective view of an earless filter mask 200*a* in accordance with one or more embodiments of the present invention. Earless filter mask 200*a* may include an inner fabric layer 110, a first filter layer (not shown), a second filter layer (not shown), an outer fabric layer 120, an elastic material 1210, and an exhalation valve 140 (outer portion 142 shown). A closure device 1230 may be used to secure a first tapered end of mask 200*a* to a second tapered end of mask 200*a*. In the certain embodiments, closure device 1230 may be an elastic shoelace, or spiral, material. A first distal end of closure device 1230 may be pulled through a first connection eyelet 1220*a* and a second distal end of closure device 1230 may be pulled through a second connection eyelet 1220*b*. The fit of earless filter mask 200*a* may be tightened or loosened by adjusting an amount of closure device 1230 that is pulled through one or more of the connection eyelets 1220*a*, 1220*b*. The inner fabric layer 110, the first filter layer (not shown), the second filter layer (not shown), and the outer fabric layer 120 may be stacked together and aligned for sewing or attachment. The elastic material 1210 may be folded over an edge of the layers and sewn or otherwise attached together along the edge. The elastic material 1210 may conform mask 200*a* to a shape of the wearer's face (not shown) and a first tapered end of mask 200*a* may be removably connected to a second tapered end of mask 200*a* by closure device 1230 that sits at the nape of the wearer's neck (not shown) below the wearer's ears (not shown). In contrast to earless filter mask 100, the first and second tapered ends of earless filter mask 200*a* do not meet at the nape of the wearer's neck (not shown), but instead sit along the jaw or bottom portion of the wearer's face (not shown) and closure device 1230 sits at the nape of the neck below the ears. Advantageously, this may improve fit and comfort. In certain embodiments, mask 200*a* may include a decorative layer (not shown), such as, for example, lace accoutrements, disposed on the outer facing surface of outer fabric layer 120, that may be aesthetically pleasing and coordinated with the wearer's ensemble. In certain embodiments, a secondary piece of fabric (not shown) may be crossed at the back of the neck and brought up the sides of the face, over or behind the ears, to tie on the top of the head or on one side of the head as a decorative feature. Larger pieces of secondary fabric may also be attached to mask 200*a*, crossed and wrapped to cover the hair and chest area entirely, providing a modesty cover for religious or other purposes.

Figure 12B:
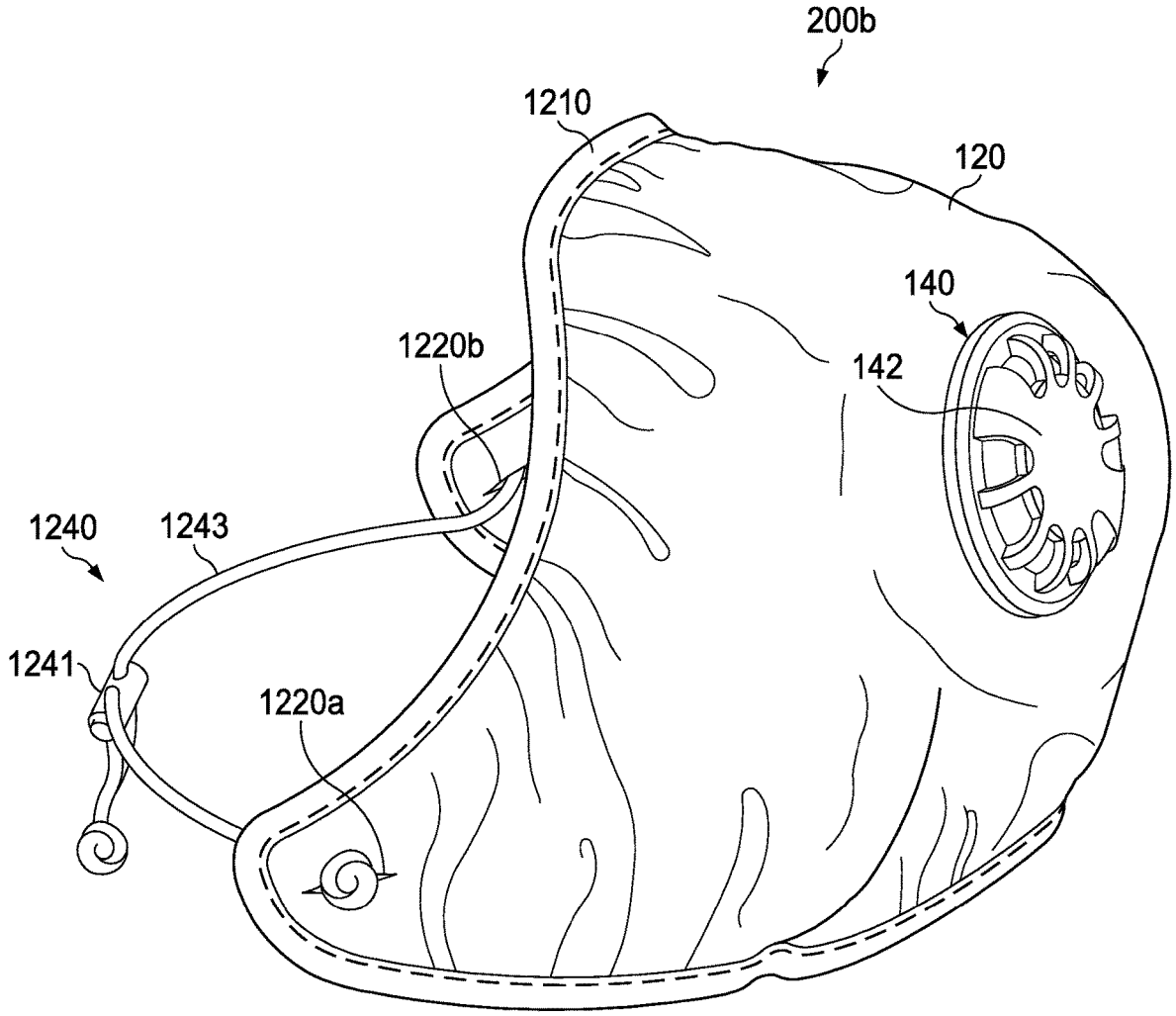

Continuing, FIG. 12B shows a perspective view of an earless filter mask 200*b* in accordance with one or more embodiments of the present invention. Earless filter mask 200*b* may be earless filter mask 200*a* with an alternative closure device 1240. In certain embodiments, closure device 1240 may be a cord 1243 and cord lock 1241. A first distal end of the cord 1243 of closure device 1240 may be pulled through connection eyelet 1220*a* and knotted to stay in place. A second distal end of the cord 1243 of closure device 1240 may be pulled through connection eyelet 1220*b* and knotted to stay in place. The fit of earless filter mask 200*a* may be tightened or loosened by adjusting the amount of cord 1243 pulled through cord lock 1241.

Figure 13A:
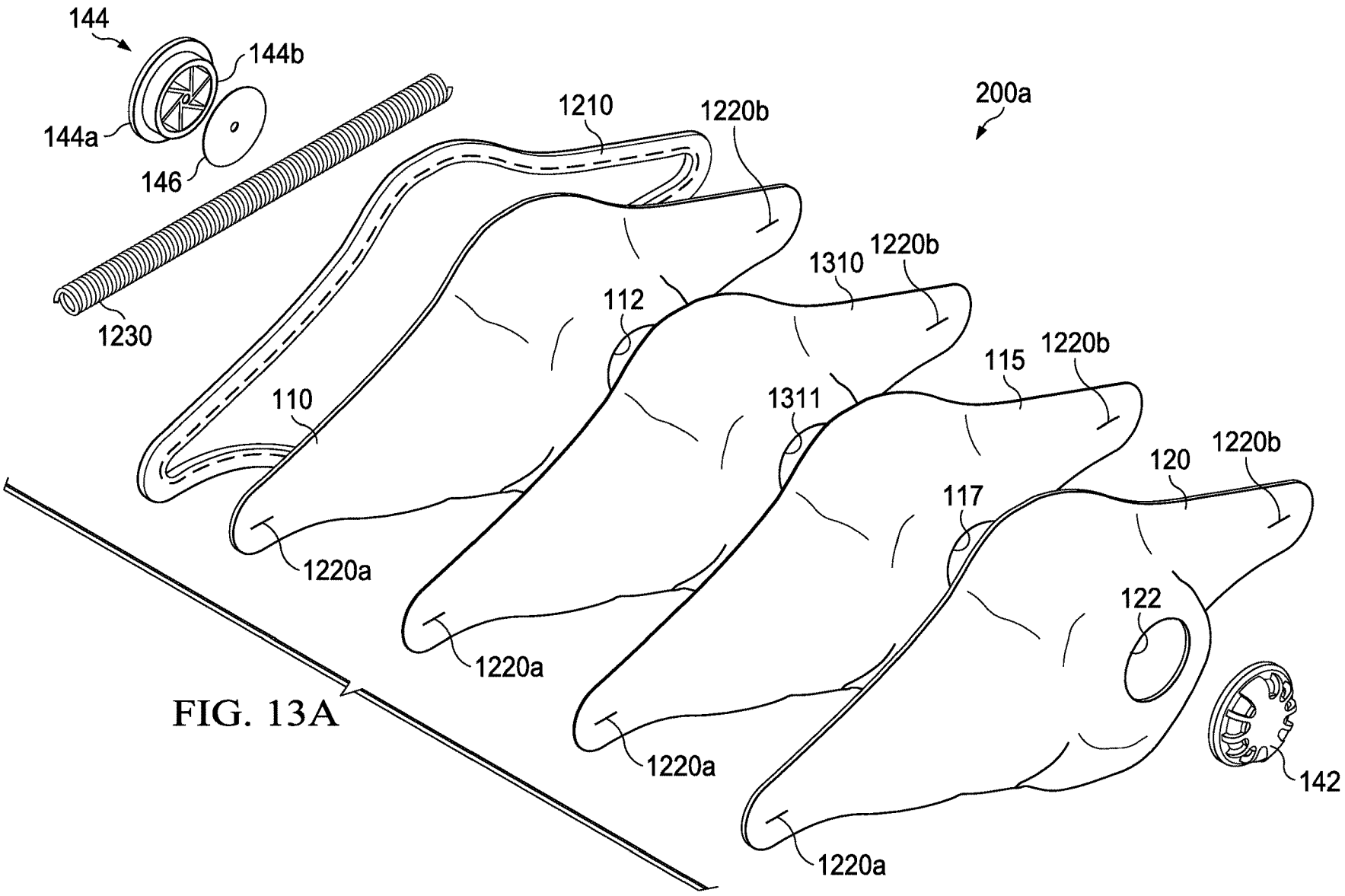
FIGS. 13A and 13B show an exploded perspective view of an earless filter mask in accordance with one or more embodiments of the present invention.

FIG. 13A shows an exploded perspective view of an earless filter mask 200*a* in accordance with one or more embodiments of the present invention. Earless filter mask 200*a* may include an inner fabric layer 110 having a first tapered end (left side), a protruding portion (center), and a second tapered end (right side). Each tapered end may include a connection eyelet 1220*a*, 1220*b*. An interior facing portion (not shown) of inner fabric layer 110 may be somewhat in contact with a wearer's face (not shown) when mask 200*a* is worn. In certain embodiments, inner fabric layer 110 may be composed of soft and breathable cotton or cotton blended fabric material. In other embodiments, inner fabric layer 110 may be composed of non-woven fabric material. In still other embodiments, inner fabric layer 110 may be composed of synthetic or synthetic blended fabric material. In still other embodiments, inner fabric layer 110 may be composed of cotton and synthetic blended fabric material. One of ordinary skill in the art will recognize that other soft and breathable materials may be used in accordance with one or more embodiments of the present invention.

Earless filter mask 200*a* may also include a first filter layer 1310. First filter layer 1310 may be an interior layer disposed between inner fabric layer 110 and second filter layer 115. First filter layer 1310 may have a first tapered end (left side), a protruding portion (center), and a second tapered end (right side) that is substantially similar in size and shape to inner fabric layer 110, second filter layer 115, and outer fabric layer 120. First filter layer 1310 may be composed of a material configured to substantially filter out one or more pollutants, while allowing inner fabric layer 110 and outer fabric layer 120 to remain breathable. In certain embodiments, first filter layer 1310 may be composed of a carbon filter material. For example, certain activated carbon filter materials may be used that protect against viruses, bacteria, and filters fumes, pollen, odors, and small particles. In other embodiments, first filter layer 1310 may be composed of a micro-particle filter material. In still other embodiments, first filter layer 1310 may be composed of non-woven fabric. In still other embodiments, first filter layer 1310 may be composed of synthetic fabric. One of ordinary skill in the art will recognize that the type or kind of filter layer may vary based on an application or design in accordance with one or more embodiments of the present invention.

Earless filter mask 200*a* may also include a second filter layer 115. Second filter layer 115 may be an interior layer disposed between first filter layer 1310 and outer fabric layer 120. Second filter layer 115 may have a first tapered end (left side), a protruding portion (center), and a second tapered end (right side) that is substantially similar in size and shape to inner fabric layer 110 and outer fabric layer 120. Second filter layer 115 may be composed of a material configured to substantially filter out one or more pollutants, while allowing inner fabric layer 110 and outer fabric layer 120 to remain breathable. In certain embodiments, second filter layer 115 may be composed of a micro-particle filter material. For example, certain micro-particle filter materials may be used that filter fine particulate matter with a diameter of 2.5 micrometers or less, commonly referred to as PM2.5. In other embodiments, second filter layer 115 may be composed of a carbon filter material. In still other embodiments, second filter layer 115 may be composed of non-woven fabric. In still other embodiments, second filter layer 115 may be composed of synthetic fabric. One of ordinary skill in the art will recognize that the type or kind of filter layer may vary based on an application or design in accordance with one or more embodiments of the present invention. In addition, one of ordinary skill in the art will recognize that the arrangement of filter layers may vary based on an application or design.

Earless filter mask 200*a* may also include an outer fabric layer 120. Outer fabric layer 120 may be the exterior facing portion of mask 200*a* having a first tapered end (left side), a protruding portion (center), and a second tapered end (right side) substantially similar in size and shape to inner fabric layer 110. In certain embodiments, outer fabric layer 120 may be composed of soft and breathable cotton or cotton blended fabric material. In other embodiments, outer fabric layer 120 may be composed of non-woven fabric material. In still other embodiments, outer fabric layer 120 may be composed of synthetic or synthetic blended fabric material. In still other embodiments, outer fabric layer 120 may be composed of cotton and synthetic blended fabric material. One of ordinary skill in the art will recognize that other soft and breathable materials may be used in accordance with one or more embodiments of the present invention.

Inner fabric layer 110, first filter layer 1310, second filter layer 115, and outer fabric layer 120 may be stacked together and aligned for sewing or attachment, an elastic material 1210 may be folded over the edge of the layers, and sewn or otherwise attached together along the edge. In FIG. 13A, elastic material 1210 is shown as it may appear once sewn in place on mask 200*a*. Elastic material 1210 conforms the mask to a shape of the wearer's face. In certain embodiments, elastic material 1210 may be composed of a flexible material that stretches in an elastic manner. One of ordinary skill in the art will recognize that other materials that conform mask 200*a* to the wearer's face (not shown) may be used in accordance with one or more embodiments of the present invention. Inner fabric layer 110, first filter layer 1310, second filter layer 115, and outer fabric layer 120 may include cutouts 112, 1311, 117, and 122 at a location corresponding to the approximate location of the nose and mouth of the wearer (not shown) that are configured to receive an exhalation valve 140 (e.g., 142, 144, and 146 may be collectively referred to as 140). Exhalation valve 140 may allow the wearer (not shown) to breathe out while wearing mask 200*a* without the buildup of gases within the interior breathing area of mask 200*a*. In addition, exhalation valve 140 may minimize moisture buildup inside mask 200*a* and the associated fogging of eyewear (not shown) while wearing mask 200*a*. Exhalation valve 140 may include an outer facing portion 142 disposed on, or otherwise secured to, an outer facing portion of outer fabric layer 120, around cutout 122 of outer fabric layer 120. Exhalation valve 140 may also include an inner facing portion 144 having a first distal end 144*a* exposed on an interior facing portion of inner fabric layer 110 and a second distal end 144*b* that extends through cutouts 112, 1311, 117, and 122 in inner fabric layer 110, first filter layer 1310, second filter layer 115, and outer fabric layer 120. Inner facing portion 144 may be removably attached to outer facing portion 142 of exhalation valve 140 with a removable valve flap 146 disposed between inner facing portion 144 and outer facing portion 142. In certain embodiments, valve flap 146 may be composed of a rubber material. In other embodiments, valve flap 146 may be composed of non-woven fabric or material. In still other embodiments, valve flap 146 may be composed of synthetic fabric or material. One of ordinary skill in the art will recognize that other filter materials may be used in accordance with one or more embodiments of the present invention. Inner fabric layer 110, first filter layer 1310, second filter layer 115, and outer fabric layer 120 may include connection eyelets 1220*a* and 1220*b* configured to receive a closure device 1230. In certain embodiments, closure device 1230 may be an elastic shoelace, or spiral, material. One of ordinary skill in the art will recognize that the type or kind of closure device 1230 may vary based on an application or design in accordance with one or more embodiments of the present invention.

Figure 13B:
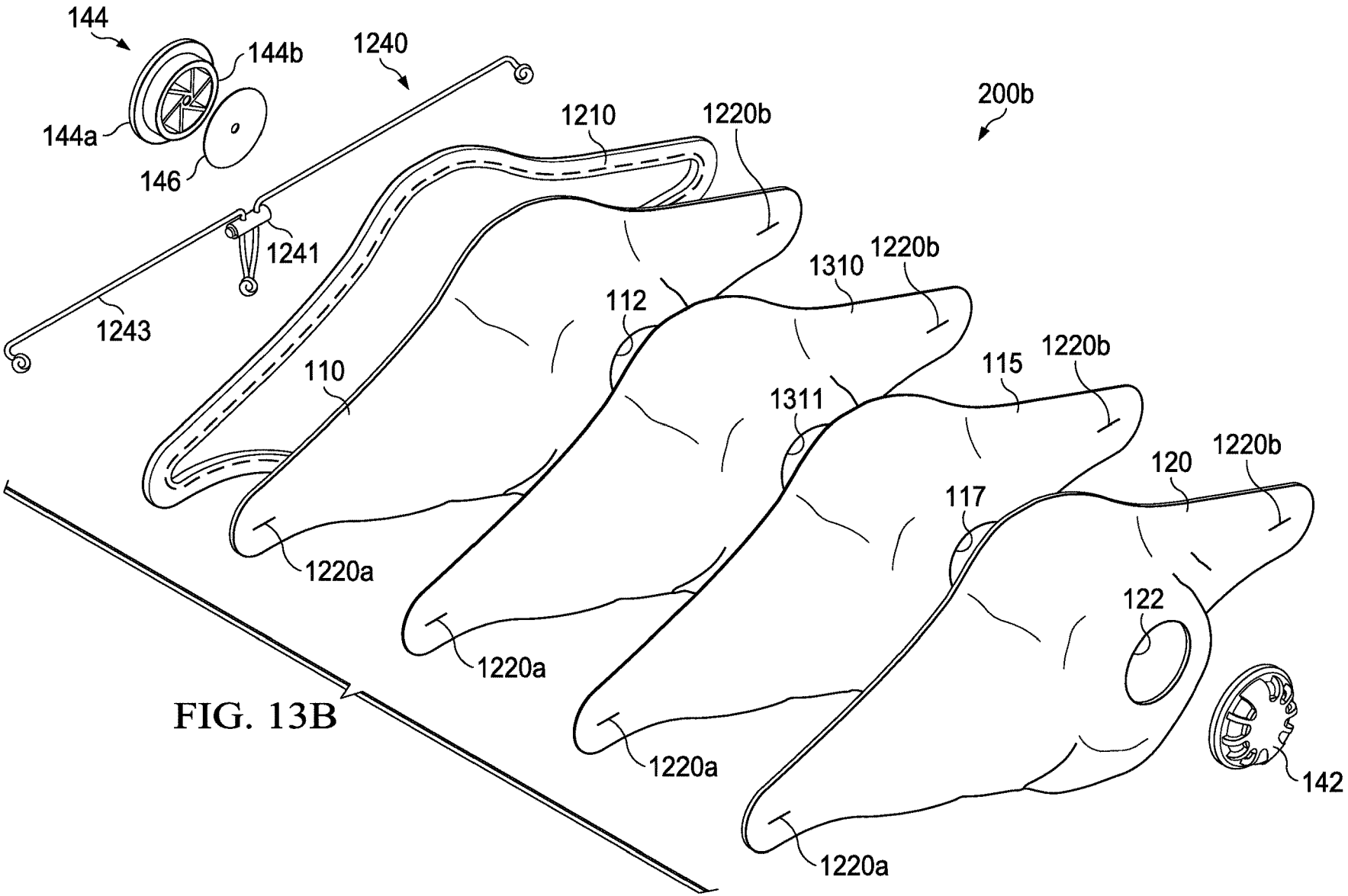

Continuing, FIG. 13B shows an exploded perspective view of an earless filter mask 200*b* in accordance with one or more embodiments of the present invention. Earless filter mask 200*b* may be earless filter mask 200*a* with an alternative closure device 1240. In certain embodiments, closure device 1240 may be a cord 1243 and cord lock 1241. One of ordinary skill in the art will recognize that the type or kind of closure device 1240 may vary based on an application or design in accordance with one or more embodiments of the present invention.

Figure 14A:
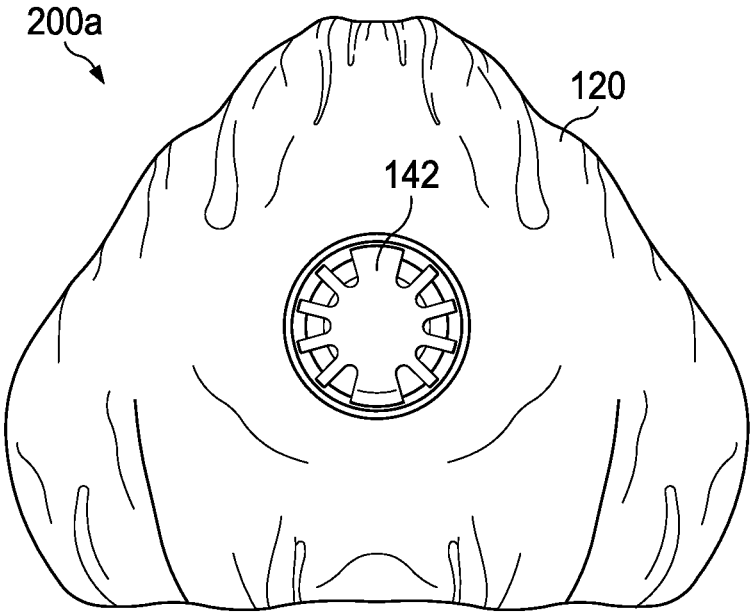
FIGS. 14A and 14B show a front elevation view of an earless filter mask in accordance with one or more embodiments of the present invention.
Figure 14B:
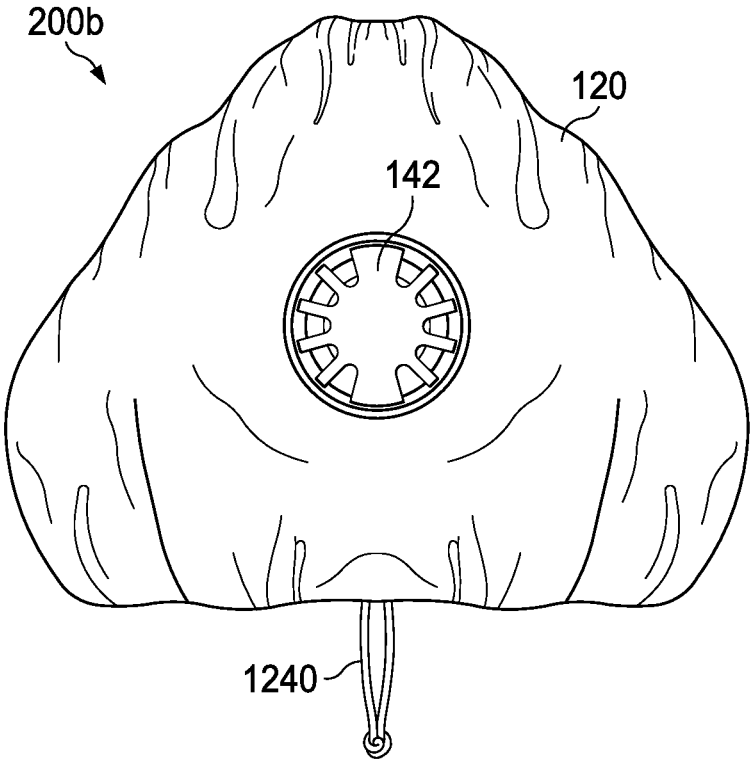

FIG. 14A shows a front elevation view of an earless filter mask 200*a* in accordance with one or more embodiments of the present invention. From the front elevation view, the protruding portion (center) of mask 200*a* that covers the wearer's nose and mouth (not shown) is shown. An elastic material (not shown) may be folded around the edge of the fabric and filter layers of mask 200*a* and sewn or otherwise attached together. The elastic material (not shown) allows mask 200*a* to comfortably conform to the shape of the wearer's face (not shown). The portion of the elastic material (not shown) disposed on a top potion of mask 200*a* allows mask 200*a* to conform, for example, to the shape of the wearer's face from the bridge of the nose to the cheeks (not shown) and the portion of the elastic material (not shown) disposed on a bottom portion of mask 200*a* allows mask 200*a* to conform, for example, to the shape of the wearer's face from the jaw to where the neck meets the jaw (not shown). Continuing, FIG. 14B shows a front elevation view of an earless filter mask 200*b* in accordance with one or more embodiments of the present invention. Earless filter mask 200*b* may be earless filter mask 200*a* with an alternative closure device 1240.

Figure 15A:
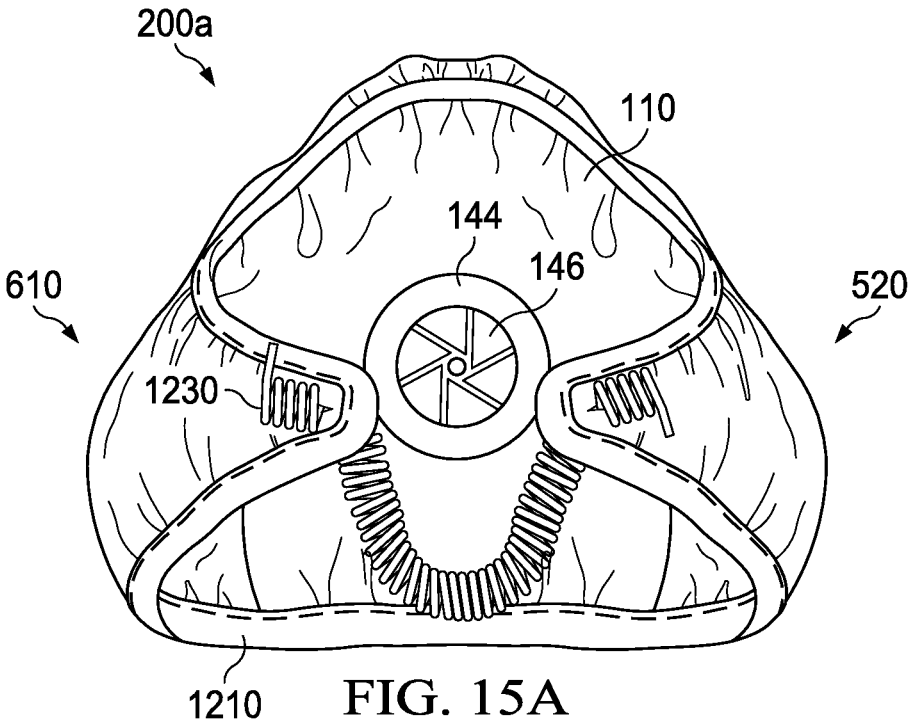
FIGS. 15A and 15B show a rear elevation view of an earless filter mask in accordance with one or more embodiments of the present invention.
Figure 15B:
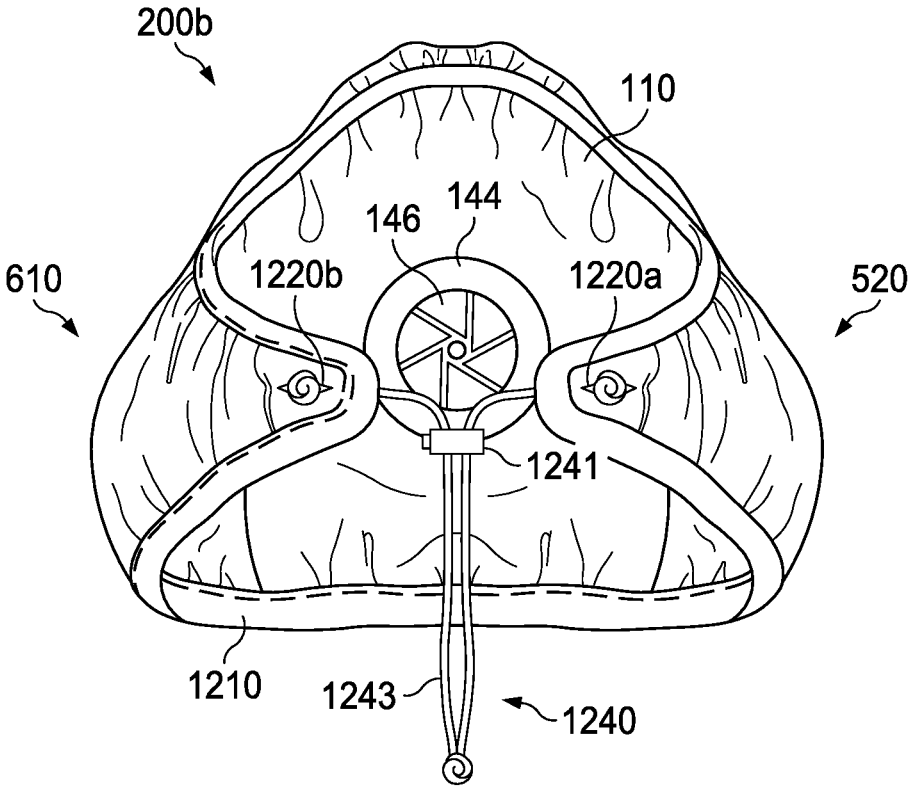

FIG. 15A shows a rear elevation view of an earless filter mask 200*a* in accordance with one or more embodiments of the present invention. From the rear elevation view, an interior breathing area of mask 200*a* is shown. An inner facing portion 144 of exhalation valve 140 and a portion of valve flap 146 are shown. A first tapered end (right tapered side in view) of mask 200*a* may be connected to a second tapered end (left tapered side in view) of mask 200*a* by a closure device 1230. As discussed above, elastic material 1210 allows mask 200*a* to conform to the shape of the wearer's face (not shown) including around the jaw and neck to the point where the first and second tapered ends of mask 200*a* are secured to one another by closure device 1230 at the nape of the wearer's neck (not shown). Continuing, FIG. 15B shows a rear elevation view of an earless filter mask 200*b* in accordance with one or more embodiments of the present invention. Earless filter mask 200*b* may be earless filter mask 200*a* with an alternative closure device 1240.

Figure 16A:
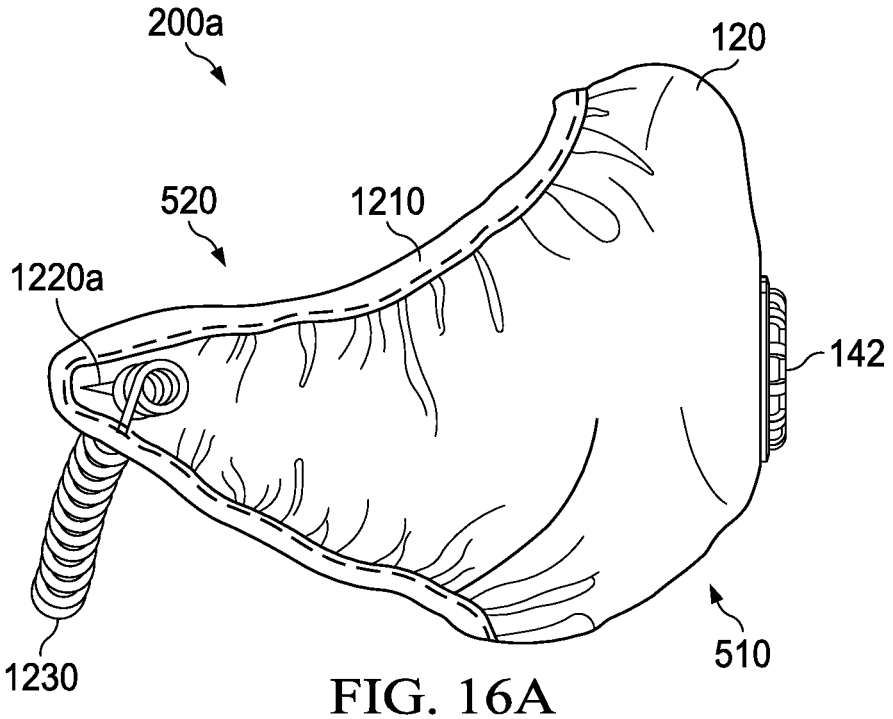
FIGS. 16A and 16B show a left side elevation view of an earless filter mask in accordance with one or more embodiments of the present invention.
Figure 16B:
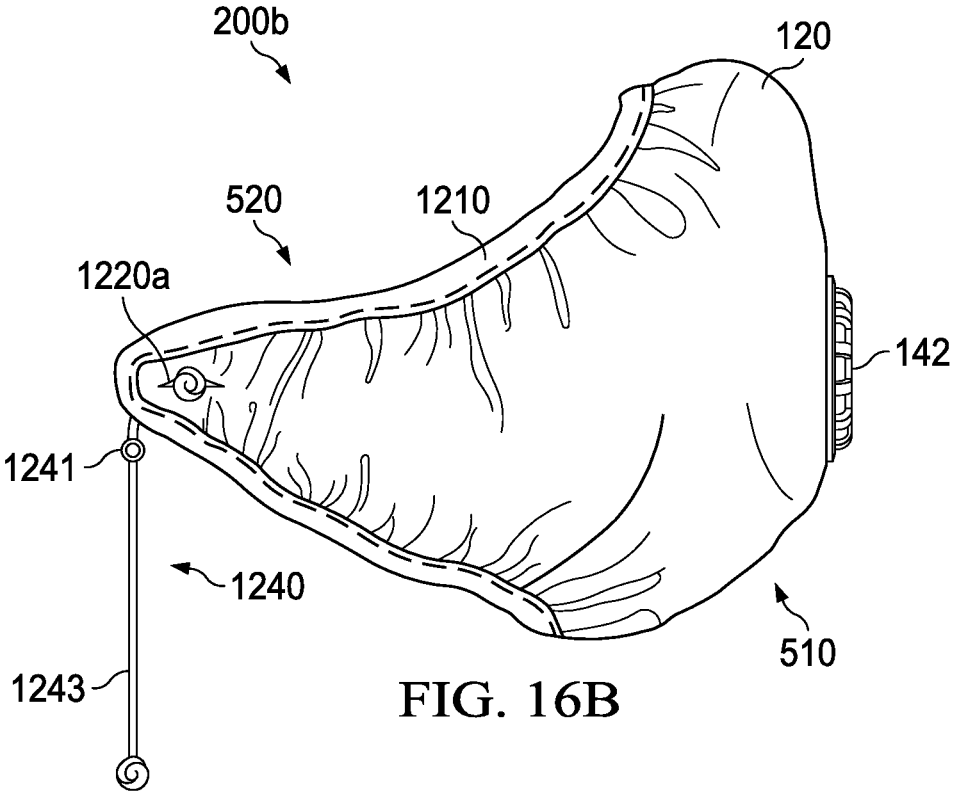

FIG. 16A shows a left side elevation view of an earless filter mask 200*a* in accordance with one or more embodiments of the present invention. From the left side elevation view, protruding portion 510 of mask 200*a* that may be configured to cover the wearer's nose and mouth (not shown) and first tapered end 520 of mask 200*a* are shown. The tapering down from protruding portion 510 to first tapered end 520 allows first tapered end 520 to be secured to the second tapered end (not shown) by closure device 1230 at the nape of the wearer's neck (not shown) below the wearer's ears (not shown) while still providing full coverage of the wearer's nose and mouth (not shown). Elastic material 1210 allows mask 200*a* to conform to the wearer's face (not shown). Continuing, FIG. 16B shows a left side elevation view of an earless filter mask 200*b* in accordance with one or more embodiments of the present invention. Earless filter mask 200*b* may be earless filter mask 200*a* with an alternative closure device 1240.

Figure 17A:
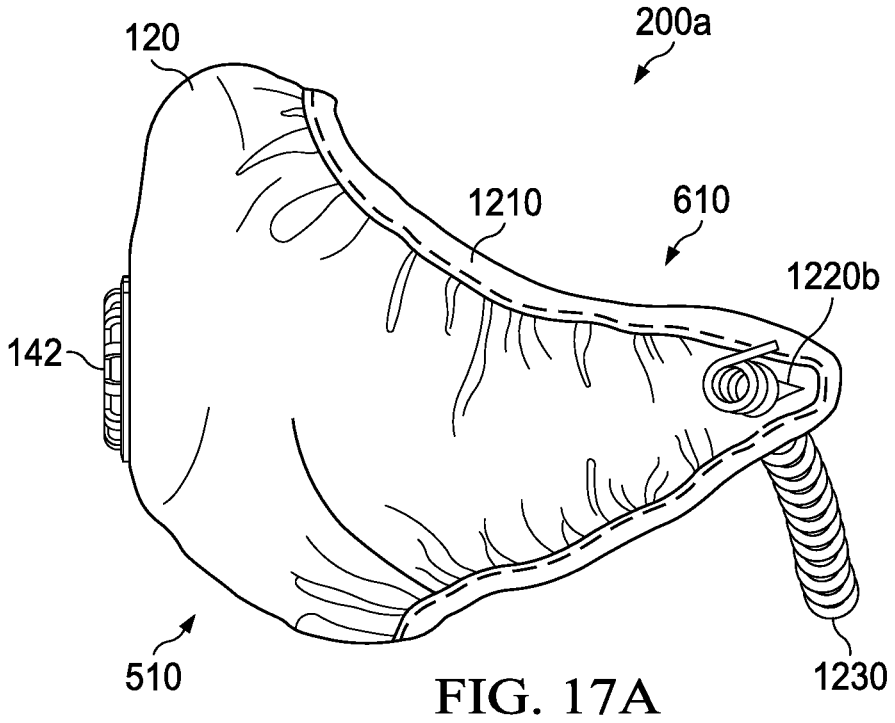
FIGS. 17A and 17B show a right side elevation view of an earless filter mask in accordance with one or more embodiments of the present invention.
Figure 17B:
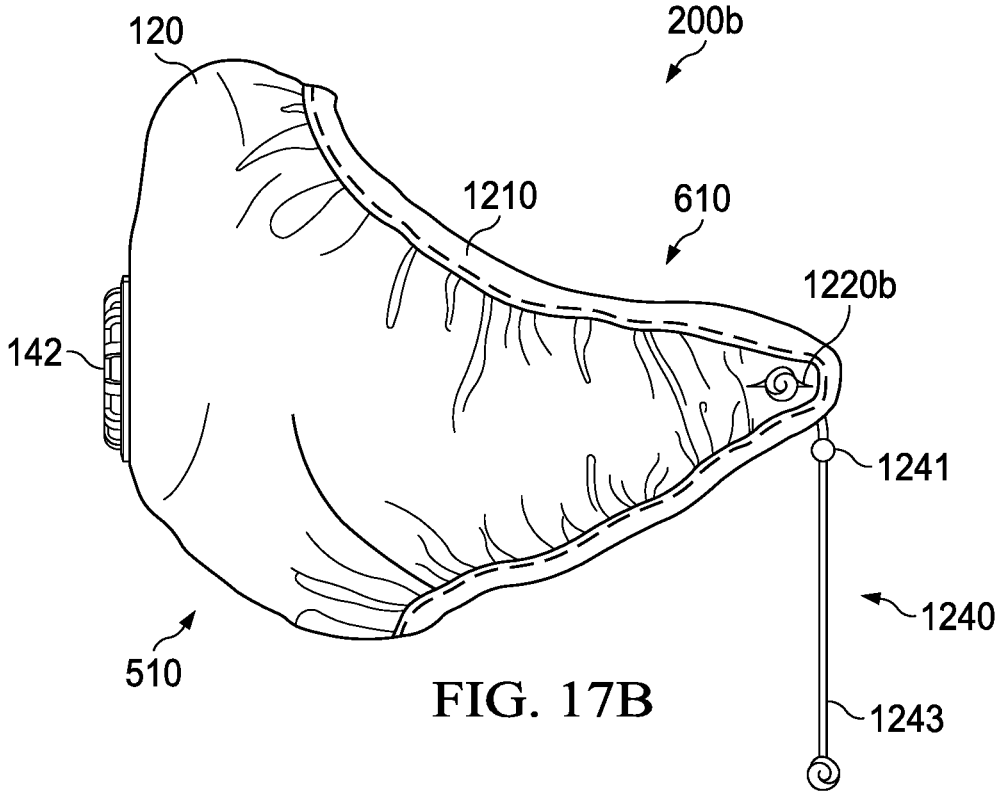

FIG. 17A shows a right side elevation view of an earless filter mask 200*a* in accordance with one or more embodiments of the present invention. From the right side elevation view, protruding portion 510 of mask 200*a* and second tapered end 610 of mask 200*a* are shown. The tapering down from protruding portion 510 to second tapered end 610 allows the first tapered end (520 of FIG. 5) to be secured to second tapered end 610 by closure device 1230 at the nape of the wearer's neck (not shown) below the wearer's ears (not shown) while still providing full coverage of the wearer's nose and mouth (not shown). The elastic material 1210 allows mask 200*a* to conform to the wearer's face (not shown). Continuing, FIG. 17B shows a right side elevation view of an earless filter mask 200*b* in accordance with one or more embodiments of the present invention. Earless filter mask 200*b* may be earless filter mask 200*a* with an alternative closure device 1240.

Figure 18A:
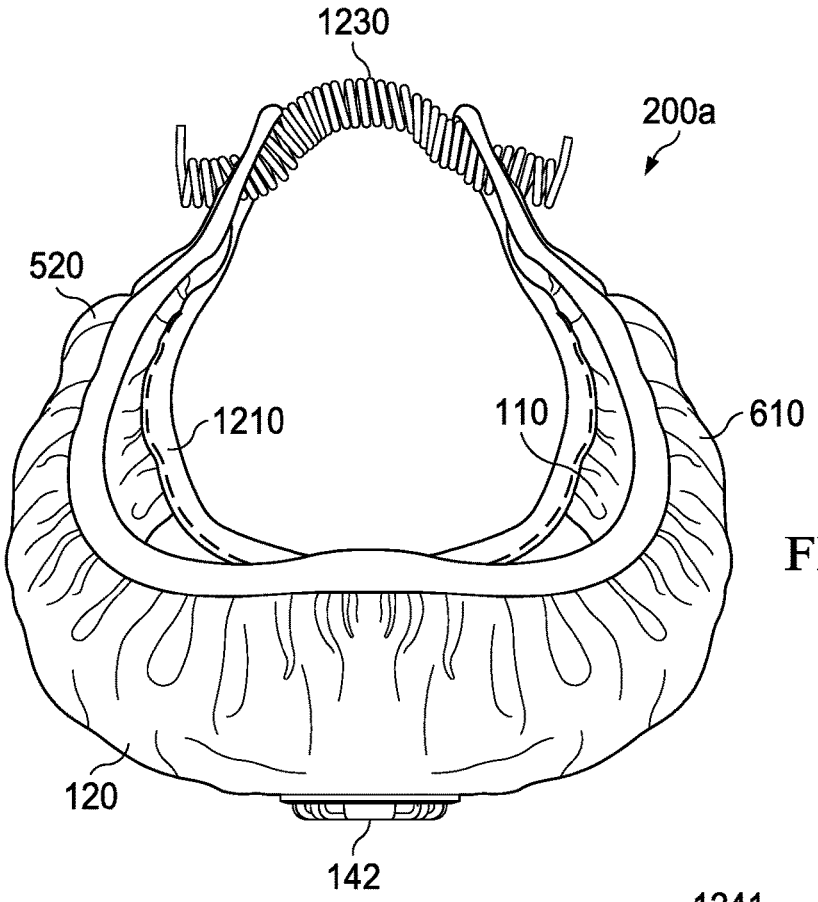
FIGS. 18A and 18B show a top plan view of an earless filter mask in accordance with one or more embodiments of the present invention.
Figure 18B:
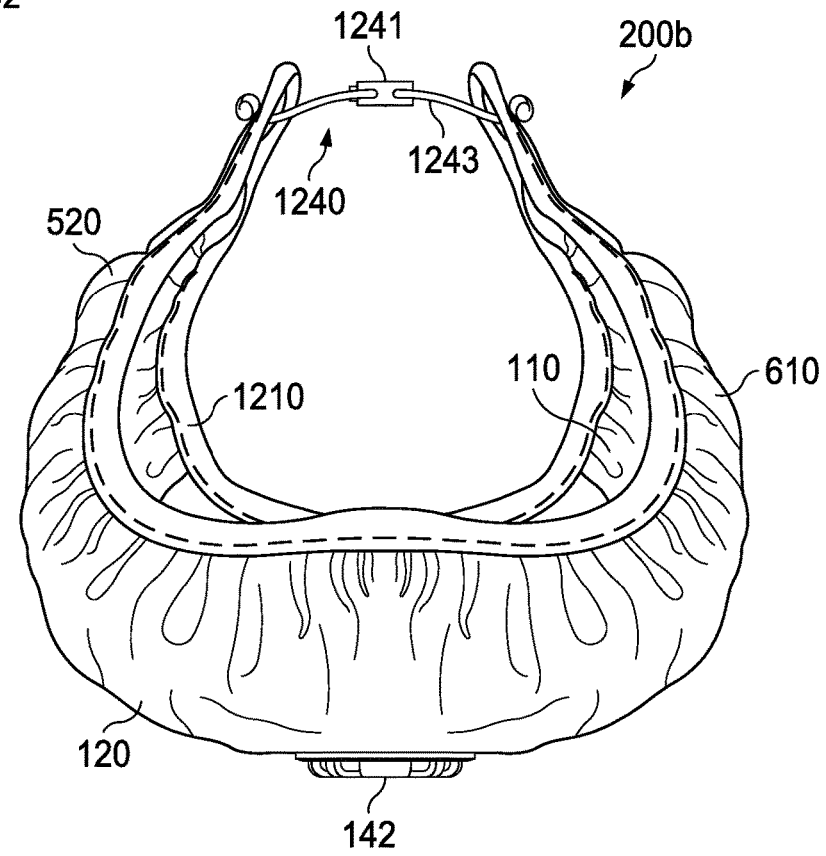

FIG. 18A shows a top plan view of an earless filter mask 200*a* in accordance with one or more embodiments of the present invention. From the top plan view, first tapered end 520 is shown secured to second tapered end 610 by closure device 1230 as if a wearer (not shown) is wearing mask 200*a*. Continuing, FIG. 18B shows a top plan view of an earless filter mask 200*b* in accordance with one or more embodiments of the present invention. Earless filter mask 200*b* may be earless filter mask 200*a* with an alternative closure device 1240.

Figure 19A:
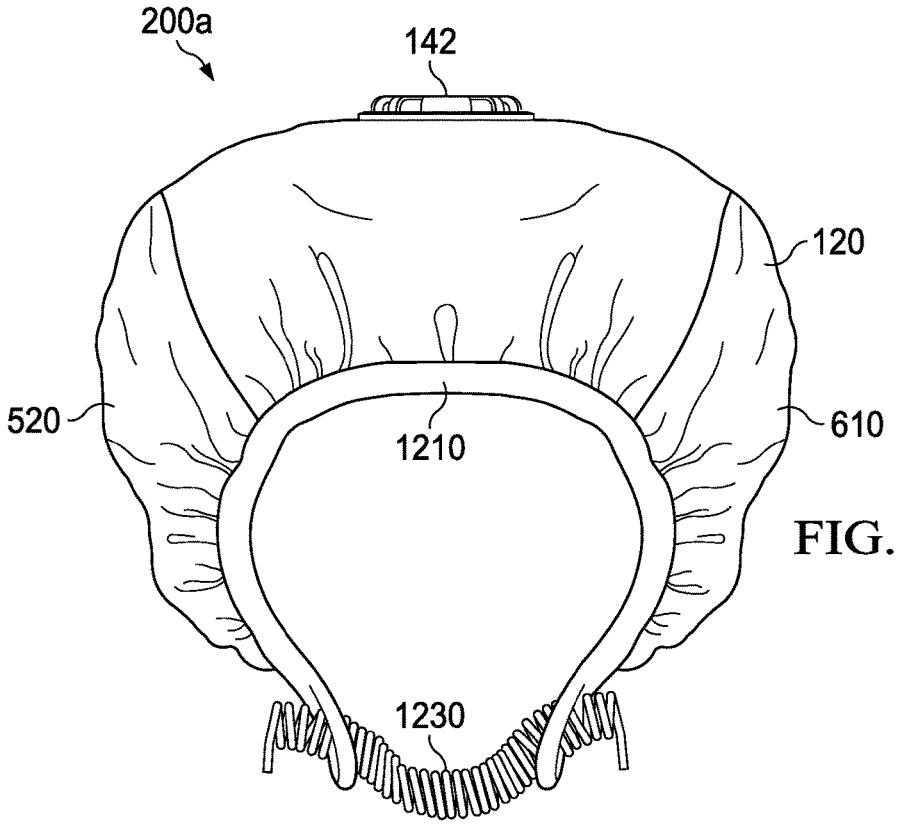
FIGS. 19A and 19B show a bottom plan view of an earless filter mask in accordance with one or more embodiments of the present invention.
Figure 19B:
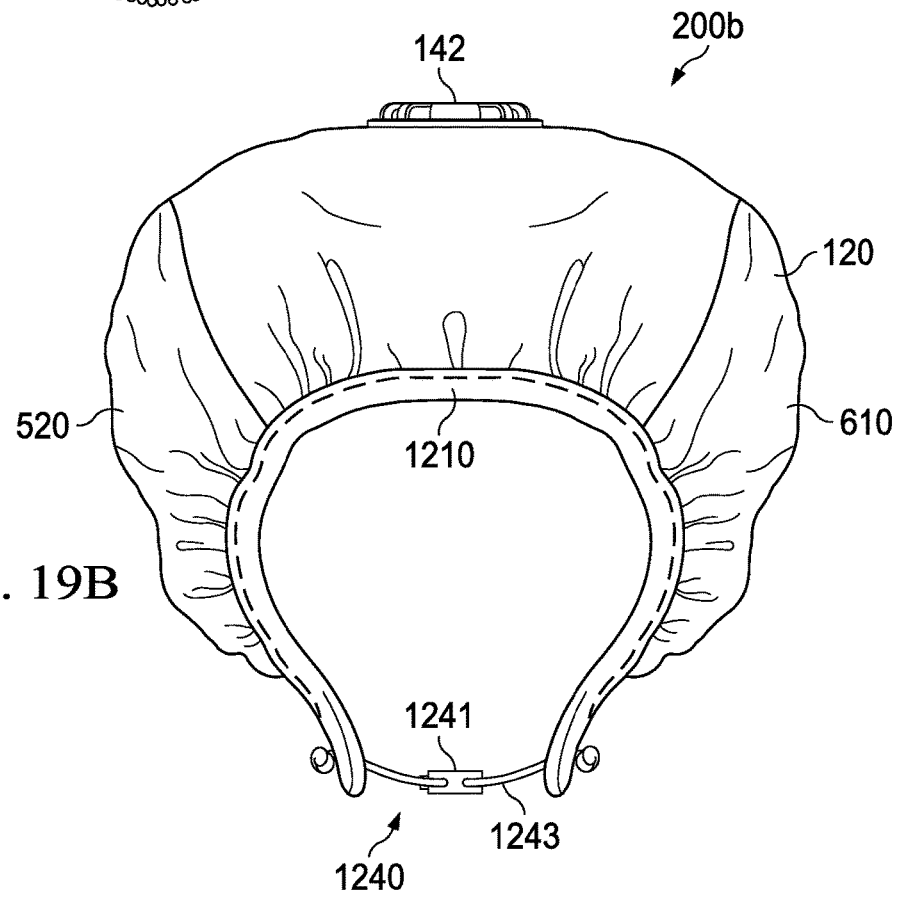

FIG. 19A shows a bottom plan view of an earless filter mask 200*a* in accordance with one or more embodiments of the present invention. From the bottom plan view, first tapered end 520 is shown secured to second tapered end 610 by closure device 1230 as if a wearer (not shown) is wearing mask 200*a*. Continuing, FIG. 19B shows a bottom plan view of an earless filter mask 200*b* in accordance with one or more embodiments of the present invention. Earless filter mask 200*b* may be earless filter mask 200*a* with an alternative closure device 1240.

Figure 20:
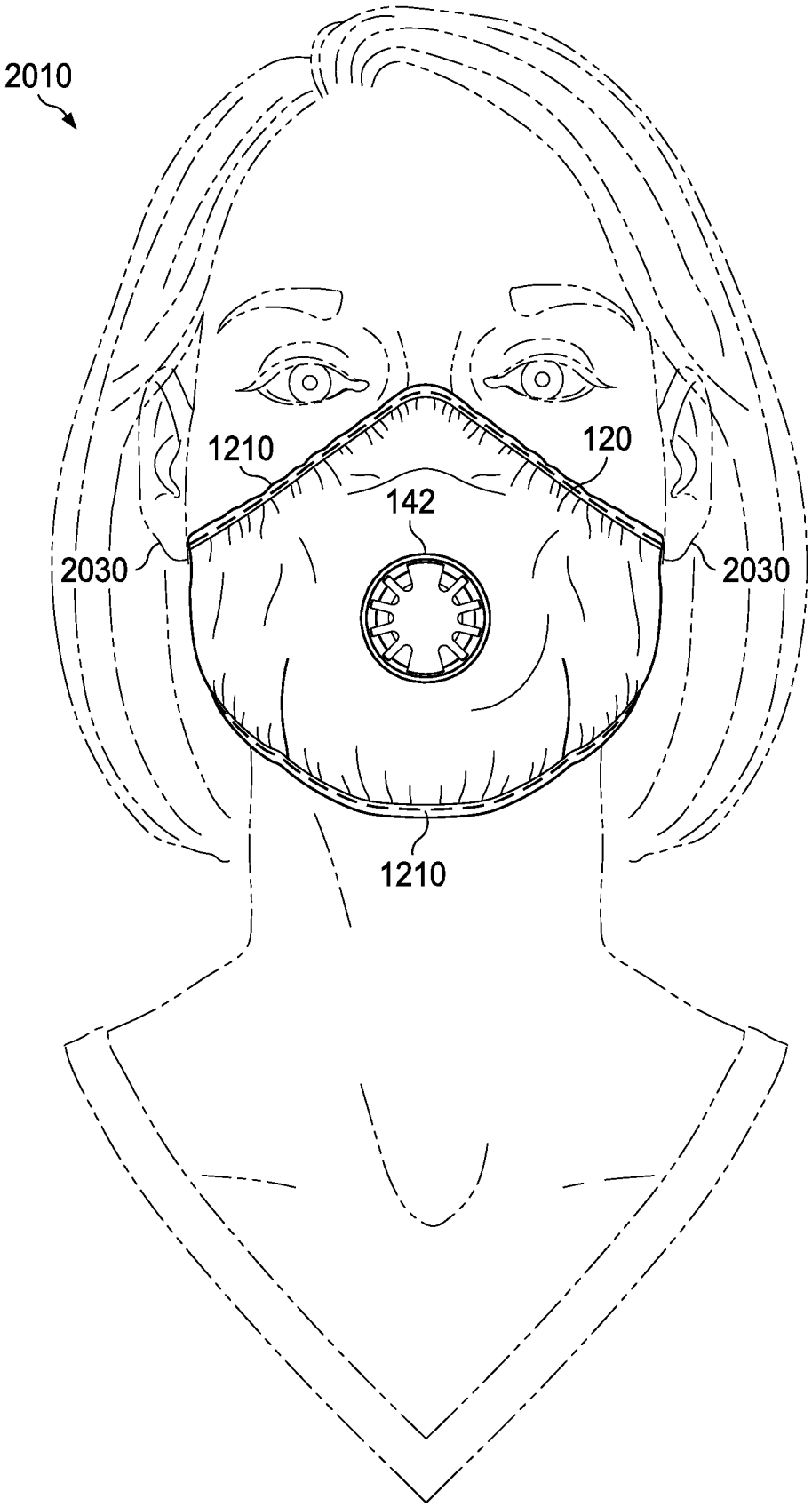
FIG. 20 shows a front elevation environmental view of an earless filter mask in accordance with one or more embodiments of the present invention.

FIG. 20 shows a front elevation environmental view of an earless filter mask 200*a* in accordance with one or more embodiments of the present invention. Earless filter mask 200*a* may be placed over a wearer's 2010 nose and mouth (not independently illustrated). Because elastic material 1210 is sewn or otherwise attached around the edge of mask 200*a*, a tight seal is formed with the wearer's 2010 face including the area from the bridge of the nose to the cheeks and the area along the bottom jawline of the wearer 2010. As such, air may enter the mask through the outer fabric layer 120, is then filtered by the second filter layer (115 of FIG. 13), then the first filter layer (1310 of FIG. 13), and then traverses the inner fabric layer (110 of FIG. 2) such that the wearer may breathe the filtered air disposed drawn into the interior breathing area of mask 2001. The wearer 2010 may exhale through the exhalation valve 142.

Figure 21A:
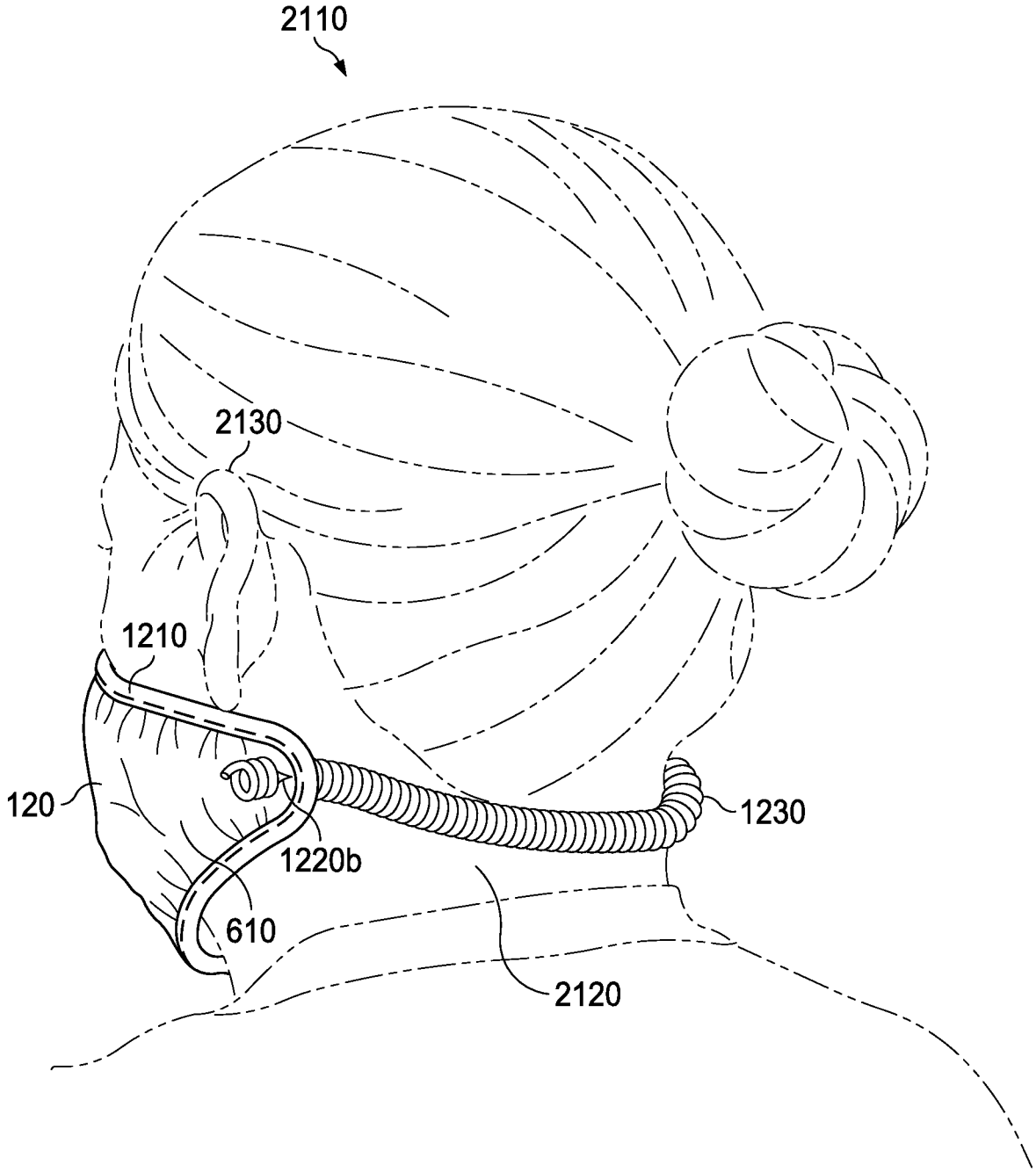
FIGS. 21A and 21B show a rear perspective environmental view of an earless filter mask in accordance with one or more embodiments of the present invention.
Figure 21B:
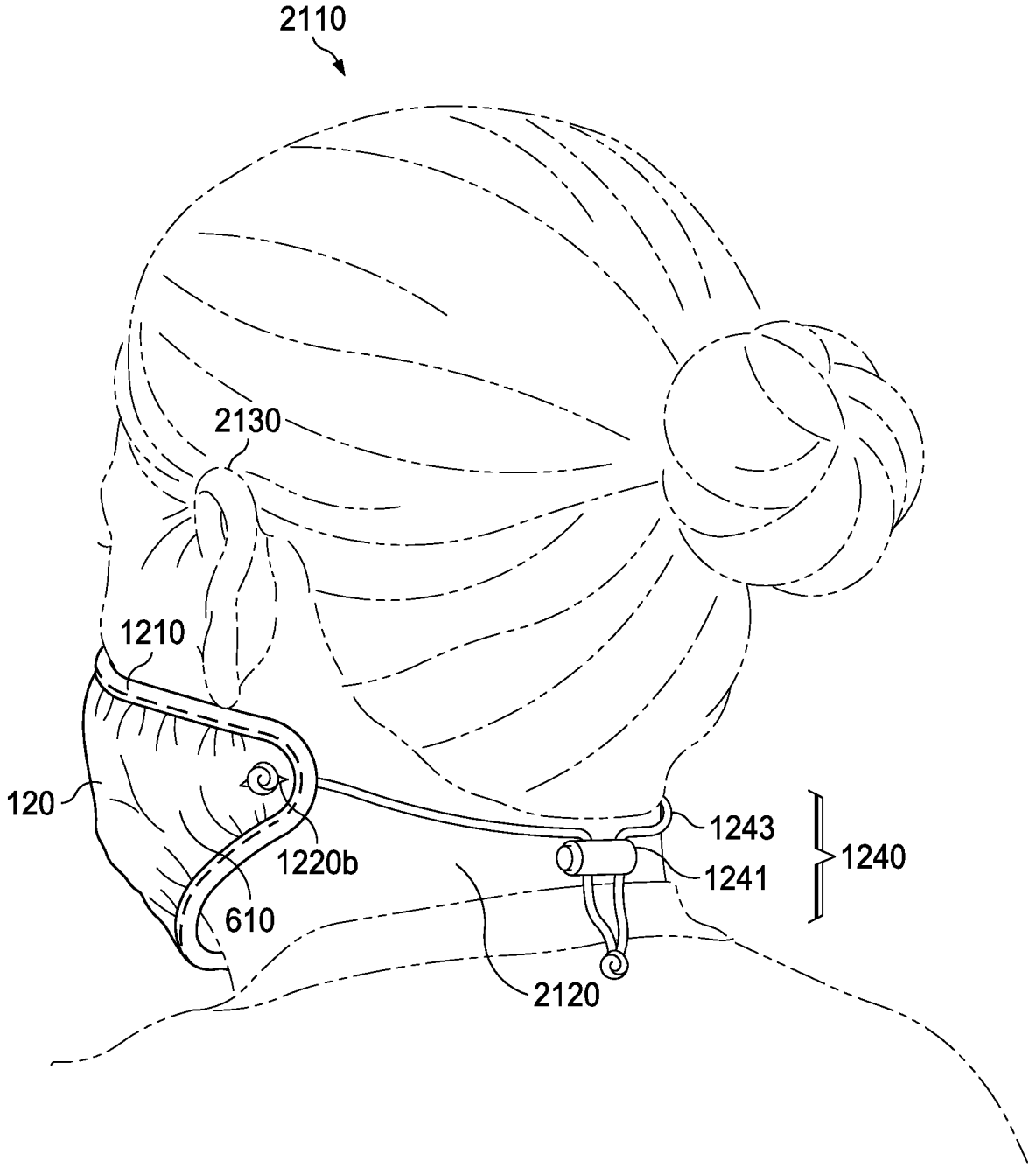

FIG. 21A shows a rear perspective environmental view of an earless filter mask 200*a* in accordance with one or more embodiments of the present invention. A first tapered end (e.g., 520) of mask 200*a* may be secured to a second tapered end (e.g., 610) of mask 200*a* with closure device 1230 that sits at the nape 2120 below the wearer's 2110 ears 2130. For example, wearer 2110 may pull a first distal end (not independently illustrated) of closure device 1230 through connection eyelet (not shown) and a second distal end of closure device 1230 through connection eyelet 1220*b*. The wearer 2110 may tighten or loosen the fit by adjusting the amount of elastic material of closure device 1230 that is pulled through one or more of the connection eyelets 1220*a*, 1220*b*. Continuing, FIG. 21B shows a rear perspective environmental view of an earless filter mask 200*b* in accordance with one or more embodiments of the present invention. Earless filter mask 200*b* may be earless filter mask 200*a* with an alternative closure device 1240. The wearer 2110 may tighten or loosen the fit of mask 200*b* by adjusting the amount of cord 1243 pulled through cord lock 1241.

Figure 22A:
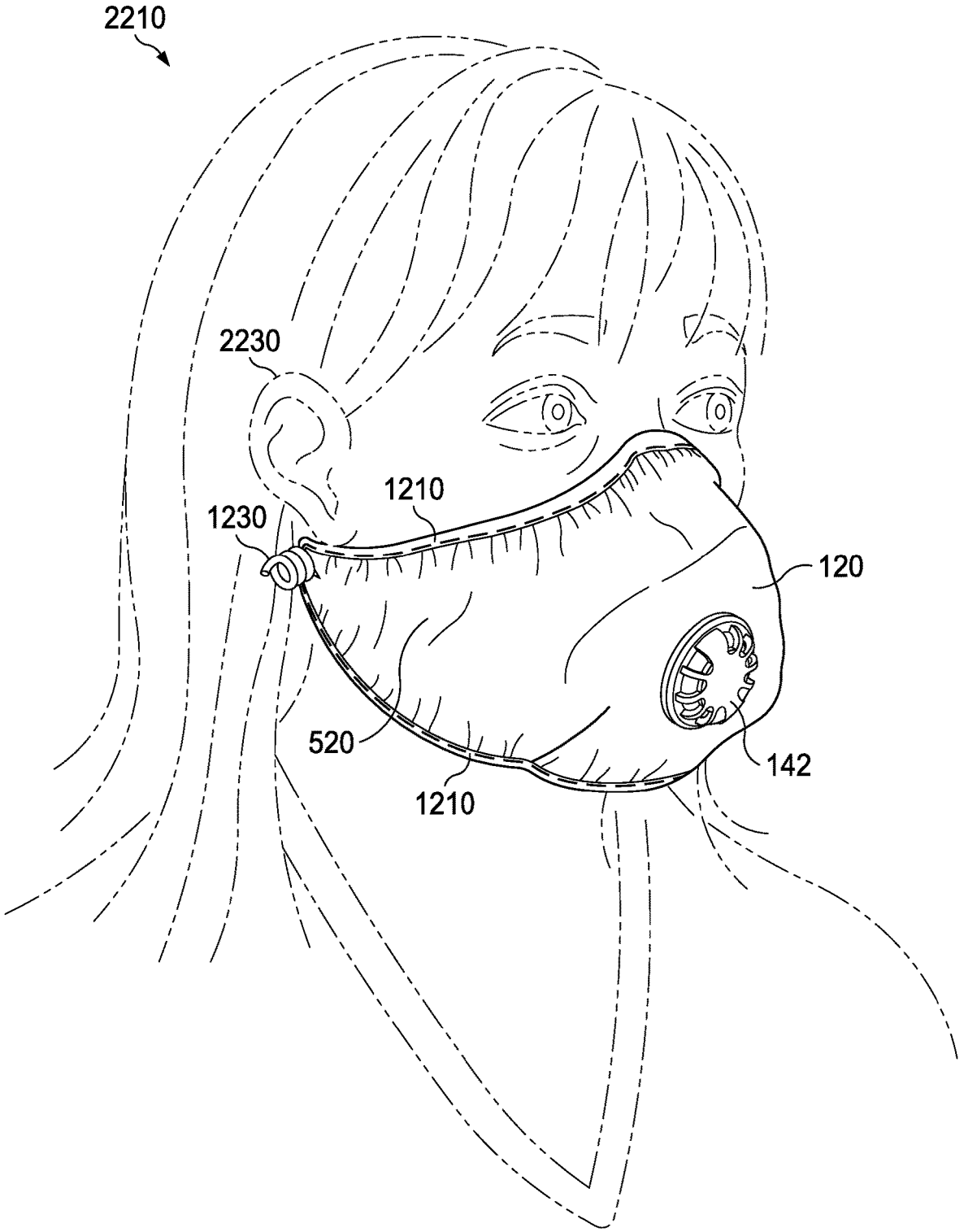
FIG. 22A and 22B show a front perspective environmental view of an earless filter mask in accordance with one or more embodiments of the present invention.
Figure 22B:
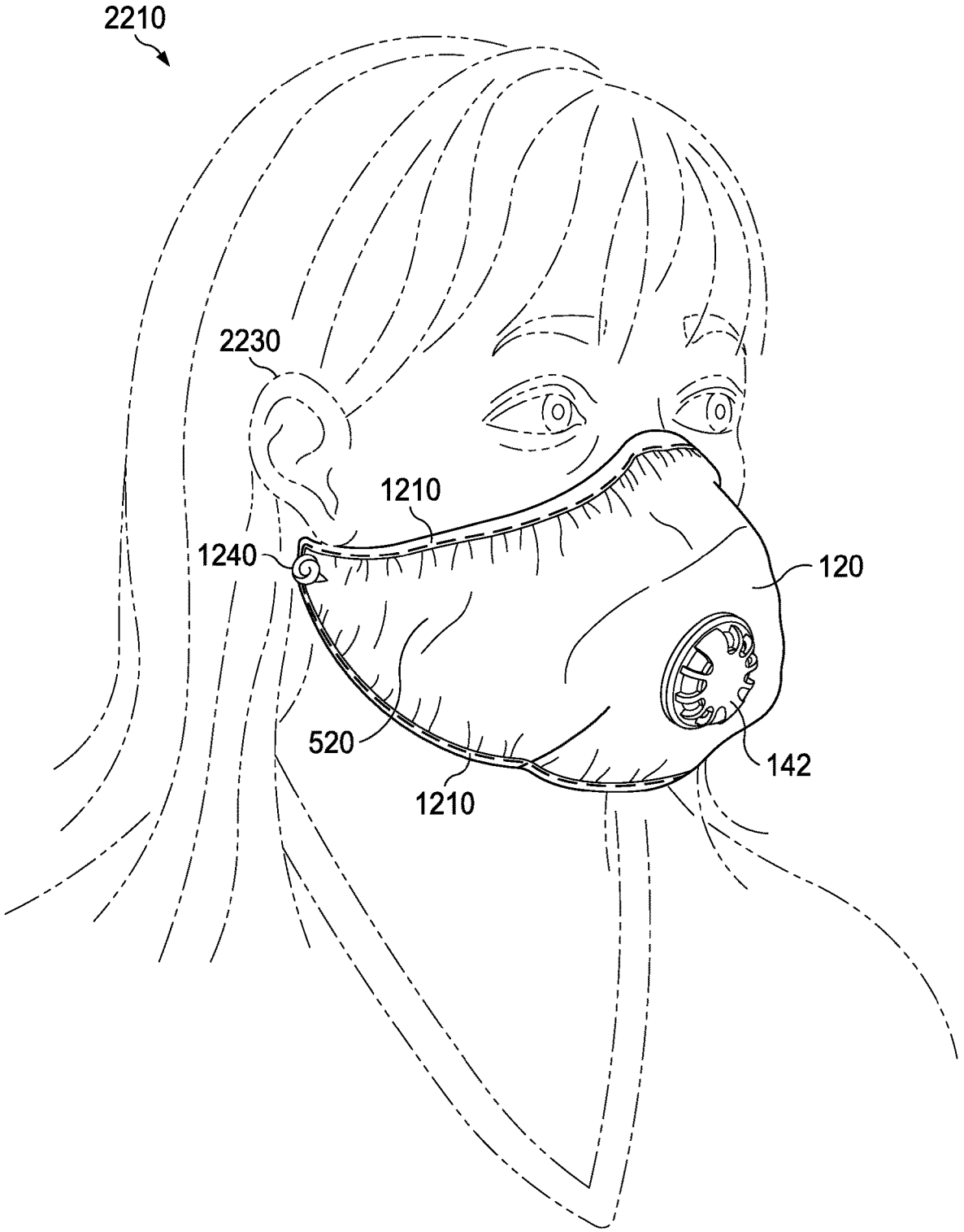

FIG. 22A shows a front perspective environmental view of an earless filter mask 200*a* in accordance with one or more embodiments of the present invention. From the front perspective environmental view, wearer 2210 is shown wearing mask 200*a*. Mask 200*a* in situ provides a small profile and is made of a soft breathable material that conforms to the shape of the wearer's 2210 face. Mask 200*a* may be comfortable to wear for extended periods of time, prevents the unintentional inhalation of polluted air, and is aesthetically pleasing. The filter layers (e.g., 115, 1310) may prevent the inhalation of polluted air through the fabric layers of the mask, while remaining constructed of breathable material, and a single exhalation valve (portion 142 shown) may allow a wearer to breathe out while wearing the mask without the buildup of gases within the interior breathing area of the mask 200*a* or a warm sensation for the wearer 2210. Continuing, FIG. 22B shows a front perspective environmental view of an earless filter mask 200*b* in accordance with one or more embodiments of the present invention. Earless filter mask 200*b* may be earless filter mask 200*a* with an alternative closure device 1240.

Advantages of one or more embodiments of the present invention may include one or more of the following:

In one or more embodiments of the present invention, an earless filter mask may include a multi-layer construction, including one or more interior filter layers, which wraps around and conforms to the shape of the wearer's face and tapers down in size to fasten at the nape of the wearer's neck below the ears. In certain embodiments, a conforming band may be sewn into the upper and the lower edges of the mask to conform the mask to the shape of the wearer's face and to secure each tapered end of the mask to a button disposed on the opposing tapered end of mask at the nape. In other embodiments, an elastic material may be sewn around an outer edge of the mask and also confirms the mask to the shape of the wearer's face. The first tapered end may be secured to the second tapered end with a closure device. The earless filter mask does not require attachment to the ears and promotes comfortable wear for extended periods of time.

In one or more embodiments of the present invention, an earless filter mask provides a unique shape that includes, in certain embodiments, a conforming band on upper and lower edges of the mask that allow the mask to conform to a wearer's face, and in other embodiments, an elastic material sewn around the edge of the mask. In addition to conforming along a front facing portion of the wearer's face, the mask conforms to the bottom and jawline of the wearer's face as the mask is pulled on and then secured around the nape of the neck.

In one or more embodiments of the present invention, an earless filter mask may include inner and outer fabric layers made of soft and breathable material.

In one or more embodiments of the present invention, an earless filter mask may include one or more filter layers, disposed between the fabric layers, that prevents the unintentional inhalation of polluted air through the fabric layers.

In one or more embodiments of the present invention, an earless filter mask may include, in certain embodiments, a conforming band that, in addition to being used to secure each tapered end of the mask to other tapered end, may be used to gather the fabric layers and conform the mask to the shape of the wearer's face and, in other embodiments, an elastic material that conforms the mask to the shape of the wearer's face and a closure device that connects the tapered ends to one another for a secure fit.

In one or more embodiments of the present invention, an earless filter mask may include a single exhalation valve that allows a wearer to breathe out while wearing the mask, allows exhaled breath to escape without the buildup of gases within the interior facing portion of the mask, and minimizes moisture buildup inside the mask and the associated fogging up of eyewear.

In one or more embodiments of the present invention, an earless filter mask is comfortable to wear for extended periods of time.

In one or more embodiments of the present invention, an earless filter mask is aesthetically pleasing.

In one or more embodiments of the present invention, an earless filter mask may include a decorative layer disposed on an exterior facing portion of all or part of an outer fabric layer and one or more buttons.

In one or more embodiments of the present invention, an earless filter mask provides improved fit, improved comfort, and improved filtering while being aesthetically appealing.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. An earless filter mask comprising:

an inner fabric layer, a first filter layer, a second filter layer, and an outer fabric layer, each having a first tapered end with a first connection eyelet, a protruding portion with a cutout, and a second tapered end with a second connection eyelet, that are stacked together and aligned for sewing;

an elastic material folded over an edge of the stacked layers that is sewn together, wherein the elastic material is configured to conform the mask to a shape of a wearer's face;

an exhalation valve that extends through the cutout of the stacked layers; and a closure device comprising a first distal end pulled through the first connection eyelet of the first tapered end of the stacked layers and a second distal end pulled through the second connection eyelet of the second tapered end of the stacked layers, wherein the first tapered end of the stacked layers and the second tapered end of the stacked layers are configured to sit along a jaw of the wearer's face below the wearer's ears, wherein the first tapered end of the stacked layers is removably connected to the second tapered end of the stacked layers by the closure device that is configured to sit at a nape of the wearer's neck, below the wearer's ears, wherein the closure device comprises an elastic spiral material.

2. The earless filter mask of claim 1, further comprising:

a decorative layer disposed on an outer facing surface of the outer fabric layer.

3. The earless filter mask of claim 1, wherein the exhalation valve comprises an outer facing portion disposed over the cutout of an outer facing portion of the outer fabric layer.

4. The earless filter mask of claim 3, wherein the exhalation valve further comprises an inner facing portion having a first distal end exposed on an interior facing portion of the inner fabric layer and a second distal end that extends through the cutouts of the stacked layers and is removably attached to the outer facing portion of the exhalation valve with a valve flap disposed between the inner facing portion and the outer facing portion.

5. The earless filter mask of claim 4, wherein the valve flap comprises a rubber material.

6. The earless filter mask of claim 1, wherein the inner fabric layer comprises a cotton or cotton blended fabric material.

7. The earless filter mask of claim 1, wherein the inner fabric layer comprises a synthetic or synthetic blended fabric material.

8. The earless filter mask of claim 1, wherein the inner fabric layer comprises a cotton and synthetic blended fabric material.

9. The earless filter mask of claim 1, wherein the inner fabric layer comprises a non-woven fabric material.

10. The earless filter mask of claim 1, wherein the first filter layer comprises a carbon filter material.

11. The earless filter mask of claim 1, wherein the second filter layer comprises a micro-particle filter material.

12. The earless filter mask of claim 1, wherein the first filter layer comprises a micro-particle filter material.

13. The earless filter mask of claim 1, wherein the second filter layer comprises a carbon filter material.

14. The earless filter mask of claim 1, wherein the outer fabric layer comprises a cotton or cotton blended fabric material.

15. The earless filter mask of claim 1, wherein the outer fabric layer comprises a synthetic or synthetic blended fabric material.

16. The earless filter mask of claim 1, wherein the outer fabric layer comprises a cotton and synthetic blended fabric material.

17. The earless filter mask of claim 1, wherein the outer fabric layer comprises a non-woven fabric material.

18. The earliest filter mask of claim 11, wherein a fit of the earless filter mask is tightened or loosened by adjusting an amount of the first distal end pulled through the first connection eyelet of the stacked layers and an amount of the second distal end that is pulled through the second connection eyelet of the stacked layers.

* * * * *